US007411489B1

(12) United States Patent
Elwell et al.

(10) Patent No.: US 7,411,489 B1
(45) Date of Patent: Aug. 12, 2008

(54) SELF-ADJUSTING DUAL TECHNOLOGY OCCUPANCY SENSOR SYSTEM AND METHOD

(75) Inventors: Brian E. Elwell, Culver City, CA (US); James D. Himonas, Los Angeles, CA (US)

(73) Assignee: Cooper Wiring Devices, Inc., Houston, TX (US)

( * ) Notice: Subject to any disclaimer, the term of this patent is extended or adjusted under 35 U.S.C. 154(b) by 441 days.

(21) Appl. No.: 11/174,716

(22) Filed: Jul. 1, 2005

Related U.S. Application Data

(63) Continuation of application No. 09/745,595, filed on Dec. 21, 2000, now abandoned.

(60) Provisional application No. 60/173,528, filed on Dec. 29, 1999.

(51) Int. Cl.
*G08B 23/00* (2006.01)

(52) U.S. Cl. ..... 340/501; 340/511; 340/521; 340/522; 340/541; 307/116

(58) Field of Classification Search ..... 340/501, 340/511, 521, 522, 567, 541; 307/116, 117
See application file for complete search history.

(56) References Cited

U.S. PATENT DOCUMENTS

| | | | |
|---|---|---|---|
| 3,710,098 | A | 1/1973 | Walden |
| 3,725,888 | A | 4/1973 | Solomon |
| 4,433,809 | A | 2/1984 | Schultz |
| 4,660,024 | A | 4/1987 | McMaster |
| 4,764,755 | A | 8/1988 | Pedtke et al. |
| 4,882,567 | A | 11/1989 | Johnson |
| 5,077,548 | A | 12/1991 | Dipoala |
| 5,189,393 | A | 2/1993 | Hu |
| 5,357,170 | A | 10/1994 | Luchaco et al. |
| 5,406,173 | A | 4/1995 | Mix et al. |
| 5,442,177 | A | 8/1995 | Boulos et al. |
| 5,489,827 | A | 2/1996 | Xia |
| 5,640,143 | A | 6/1997 | Myron et al. |
| 5,729,019 | A | 3/1998 | Krafthefer et al. |
| 5,764,146 | A | 6/1998 | Baldwin et al. |
| 5,867,099 | A | 2/1999 | Keeter |

(Continued)

FOREIGN PATENT DOCUMENTS

| | | |
|---|---|---|
| EP | 1 132 046 A1 | 9/2001 |

(Continued)

*Primary Examiner*—Anh V La
(74) *Attorney, Agent, or Firm*—King & Spalding LLP

(57) ABSTRACT

The present invention provides a system comprising an occupancy sensor for sensing occupancy of an area, able to activate upon sensing occupancy of the area, maintain activation when sensing continuing occupancy, to include settings therefor, and to enable self-adjusting of the settings. It includes an infrared sensor section, able to passively sense occupancy and activate a signal, continue to activate upon sensing continuing occupancy, and enable separate processing of the settings. It also includes an ultrasonic sensor section, able to actively sense occupancy, activate a signal upon sensing continuing occupancy, and enable separate processing of the settings. The occupancy sensor is able to activate when the infrared sensor section senses occupancy, and to maintain activation when either the infrared sensor section or the ultrasonic sensor section senses continuing occupancy of the area. The infrared sensor section signals and the ultrasonic sensor section signals are each independently formed and activated.

39 Claims, 29 Drawing Sheets

U.S. PATENT DOCUMENTS

| | | | | |
|---|---|---|---|---|
| 5,986,357 | A | 11/1999 | Myron et al. | |
| 6,078,253 | A | 6/2000 | Fowler | |
| 6,151,529 | A * | 11/2000 | Batko | 700/28 |
| 6,215,398 | B1 * | 4/2001 | Platner et al. | 340/556 |
| 6,222,191 | B1 * | 4/2001 | Myron et al. | 250/353 |
| 6,285,912 | B1 | 9/2001 | Ellison et al. | |
| 6,587,049 | B1 | 7/2003 | Thacker | |
| 6,628,091 | B2 | 9/2003 | Griffin et al. | |
| 2005/0237733 | A1 | 10/2005 | Laski et al. | |
| 2007/0182554 | A1 | 8/2007 | Elwell | |
| 2007/0182580 | A1 | 8/2007 | Elwell | |
| 2007/0182581 | A1 | 8/2007 | Elwell | |
| 2007/0183329 | A1 | 8/2007 | Elwell | |

FOREIGN PATENT DOCUMENTS

| | | | |
|---|---|---|---|
| EP | 1 222 895 | A1 | 7/2002 |
| EP | 1 201 187 | A1 | 5/2005 |

* cited by examiner

SELF-ADJUSTING DUAL TECHNOLOGY OCCUPANCY SENSOR SYSTEM AND METHOD

CROSS-REFERENCE TO RELATED APPLICATION

This application is a continuation of application Ser. No. 09/745,595 filed on Dec. 21, 2000 now abandoned, which claimed the benefit of a provisional application Ser. No. 60/173,528 filed on Dec. 29, 1999.

COMPUTER PROGRAM LISTING APPENDIX

A Compact Disc-Recordable (CD-R) which includes a computer program listing, and which was submitted with the parent application, is submitted with this application, since the computer program listing has over 300 lines of code. The material on the CD-R is incorporated by reference herein.

A listing of all files contained in the compact discs enclosed herewith is as follows: machine format—IBM PC; operating system compatibility-Windows/DOS; name—Dual Tech Version 1, size—70,927 bytes, creation date—Sep. 16, 1999, type—assembly source code; name—Dual Tech Version 2, size—71,089 bytes, creation date—Nov. 18, 1999, type—assembly source code.

BACKGROUND OF THE INVENTION

1. Field of the Invention

This invention relates generally to improvements in occupancy sensor systems and method, and, more particularly, to a system for sensing the occupancy of an area to control a system connected thereto, whereby the occupancy sensing system is activated upon sensing the occupancy of the area, and activation of the occupancy sensing system is maintained while sensing the continuing occupancy of the area.

2. General Background and State of the Art

An occupancy sensor system senses the occupancy and vacancy of an area covered thereby, and activates or deactivates a system connected thereto responsive to such sensing thereof. The sensors in an occupancy sensor may include infrared and/or ultrasonic technologies. The systems controlled by occupancy sensors may consist of lighting systems, heating and air conditioning systems, alarm systems, and/or building automation systems. The area covered by an occupancy sensor may comprise a room, a classroom, a computer room, a section of a floor, and/or a floor in a building, from small areas to very large areas. The occupancy sensor may be mounted at a location in the wall or in the ceiling of the area to be covered thereby.

An important consideration regarding an occupancy sensor system is that it be energy-saving with respect to the system controlled thereby. Further, it is significant that such an occupancy sensor system be reliable and versatile. Moreover, there may have been problems associated with prior occupancy sensor systems regarding false activations, due to heavy airflow in the covered area, unintended blackouts caused by coverage gaps, and/or coverage fluctuations due to changes in humidity, temperature, and electrical noise. Further, it is desirable to provide multiple interface options for connecting an occupancy sensor system to a system to be controlled thereby such as a building automation system.

Reliable activation of the occupancy sensor upon occupancy of the area covered is a major issue, as is safeguarding against false activation during vacancy of the area covered thereby. Another major issue is that occupancy sensors which attempt to learn the occupancy patterns for the areas covered thereby, such as by a summing algorithm that uses a composite signal to determine occupancy to attempt to eliminate installer errors, may not have been reliable. A further major issue is that occupancy sensors when installed were often not setup or adjusted to the optimum settings. This often caused installers to make return trips to further adjust sensors, and for occupants to be inconvenienced by nuisance false activations or deactivations.

It would therefore be desirable to provide an occupancy sensor system which is able to provide energy-saving solutions for controlling systems connected thereto, and reliable and versatile control of the connected system, while preventing false activation and coverage fluctuations due to environmental factors and unintended non-activation in an occupied area due to gaps in system coverage, and which generates and maintains signals which provide reliable sensing of the occupancy of an area.

Therefore, there has been identified a continuing need to provide a system for sensing covered-area occupancy which provides enhanced reliability and versatility.

INVENTION SUMMARY

Briefly, and in general terms, the present invention, in a preferred embodiment, by way of example, is directed to a system for sensing the occupancy of an area, which is able to activate upon sensing occupancy of the area, maintain activation when sensing continuing occupancy of the area, and enable self-adjusting of settings thereof. The system includes an occupancy sensor, which is able to activate upon sensing the occupancy of the area, to maintain activation when sensing continuing occupancy of the area, to include settings therefor, and to enable the self-adjusting of the settings. The occupancy sensor includes an infrared sensor section, able to passively sense occupancy of the area, and to activate a signal thereupon, to continue to activate the signal upon sensing the continuing occupancy of the area, to include settings therefor, and to enable separate processing of the settings for only the infrared sensor section. It also includes an ultrasonic sensor section, able to actively sense the occupancy of the area, to activate a signal upon sensing the continuing occupancy of the area, and to enable separate processing of the settings for only the ultrasonic sensor section. The occupancy sensor is able to activate when the infrared sensor section senses occupancy of the area, and to maintain activation when either the infrared sensor section or the ultrasonic sensor section senses continuing occupancy of the area. The signals in the infrared sensor section and the ultrasonic sensor section are each independently activated and form independent signals. The independent infrared section signal and the independent ultrasonic sensor section signal are not combined to form a composite signal. The self-adjusting settings comprise time delay and sensitivity settings. The occupancy sensor is also able to maintain activation when both the infrared sensor section and the ultrasonic sensor section are independently activated and form independent signals.

In accordance with aspects of the invention, the occupancy sensor system of the invention provides the sensing of the occupancy and vacancy, and the controlling of a system, in a covered area, in a convenient, reliable, versatile, and effective manner. The system for sensing the occupancy and vacancy of an area to be covered thereby comprises a multi-featured self-adjusting dual technology occupancy sensor system in the field of building controls, occupancy sensors, electronics, and programming. The occupancy sensor includes a combination of real time adjustments and fault detection to optimize the sensitivity and time delay settings. If the sensor determines that it made a mistake in activating or deactivating, it will adjust the time delay and/or sensitivity in order to optimize the performance of the sensor. An alarm mode is included which requires multiple activations of both the ultrasonic and infrared sections of the sensor within a preset time period in order to activate the alarm relay. A pushbutton interface is included to enable manual activation of the sensor. The sensor will automatically deactivate following the time delay. A grace timer is also incorporated for safety purposes which allows automatic activation within a set period after deactivation.

The system controlled by the occupancy sensor is activated when a sensor section is activated. Versatile connections are provided for systems to be controlled thereby, including an isolated relay which may be configured for example for a building automation system or an alarm system interface via a DIP switch.

The system self-adjusts the sensitivity and time delay thereof in real time to enhance performance and reduce the need for follow-up adjustments. Coverage of the area remains stable regardless of environmental conditions therein. Concurrent time delays for the sensor sections avoids inadvertent deactivation in occupied areas.

Installation is simplified with a delay default when the system is left at minimum potentiometer setting. Environmental motion tolerant systems resist false activation in environmentally active areas such as high airflow rooms. DIP switch selectable lighting sweep setting reduces activations following power sweeps for example in facilities with computer control system. A zero time delay DIP switch is adapted for use in building automation systems and alarm modes for business management systems equipped with an internal timing function. An alarm function avoids false alarm activation, through detection redundancy testing.

A manual on/off option via a wall switch enables a building automation system relay to remain active during occupancy. The system is fully self-resetting, whereby upon manual deactivation in automatic activation mode, the controlled system remains deactivated during occupancy, and after vacancy of the area and elapse of a time delay and grace period, the controlled system activates the next time the area is occupied. A grace period allows the controlled system to be activated by motion anywhere.

The occupancy sensor may be mounted at a location in the wall or in the ceiling of the area to be covered thereby. The system also includes a setting element for enabling the input of a setting for the activating of the occupancy sensor, and a self-adjusting element, for enabling the self-adjusting of the activating setting for the activating of the occupancy sensor.

The system includes a sensitivity setting and a time delay setting for activating settings of the occupancy sensor. The self-adjusting element is able to self-adjust the settings responsive to real-time adjustment and/or fault detection. The occupancy sensor is able to activate upon sensing motion in the area. The system is further able to be self-resetting. The system may further include a building automation system relay, able to be connected to the occupancy sensor and to a building automation system.

The system may also include an alarm relay, able to be connected to the occupancy sensor and to an alarm system, wherein the setting element may be a switch able to enable the selection of an alarm mode setting, and able to require multiple activations of the infrared sensor section and the ultrasonic sensor section within a preset time period to activate the alarm relay. The system may further include an interface for enabling manual setting for activation of the occupancy sensor.

These and other objects and advantages of the invention will become apparent from the following detailed description and the accompanying drawings, which illustrate by way of example the features of the invention.

DETAILED DESCRIPTION OF THE PREFERRED EMBODIMENTS

Figure 1:
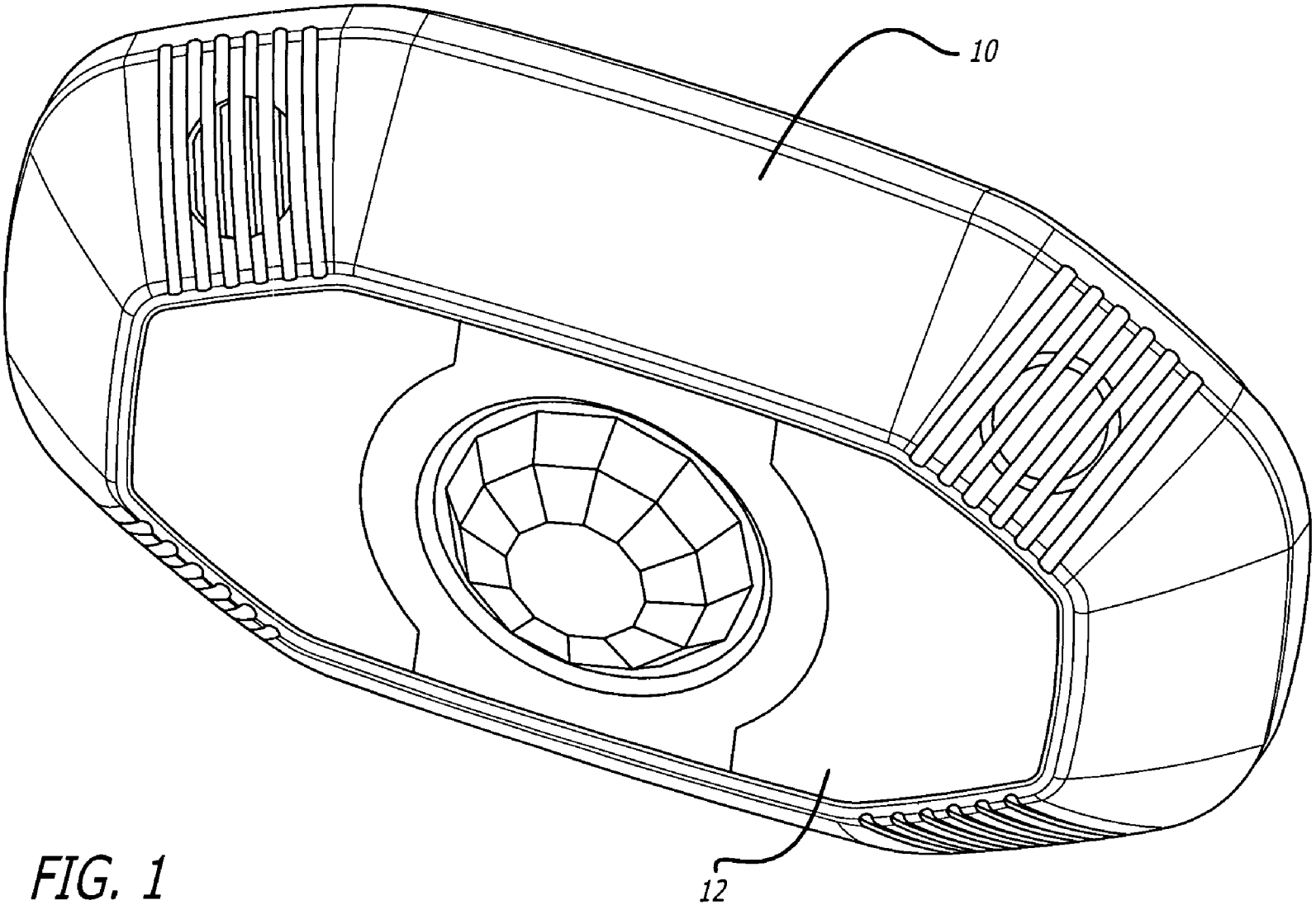
FIG. 1 is a perspective view of a dual technology occupancy sensor system, in accordance with aspects of the present invention.

Referring to the drawings, in which like reference numerals refer to like or corresponding parts, the system 10 according to the invention provides reliable activation during occupancy of the covered area, and safeguards against false activation during vacancy of the area. The system 10 is able to activate upon sensing occupancy of the area, maintain activation when sensing continuing occupancy of the area, and enable self-adjusting of settings thereof.

FIG. 1 presents a system 10 which is utilized for the sensing of the occupancy and vacancy of the covered area. It includes an occupancy sensor 12, able to be installed for example in the ceiling of an area to be covered thereby such as a room in a building, and to be connected to a system to be controlled thereby such as a room lighting system. The occupancy sensor 12 is able to activate upon sensing the occupancy of the area, maintain activation when sensing continuing occupancy of the area, to enable settings therefor, and to enable self-adjusting of the settings.

Figures 1, 2:
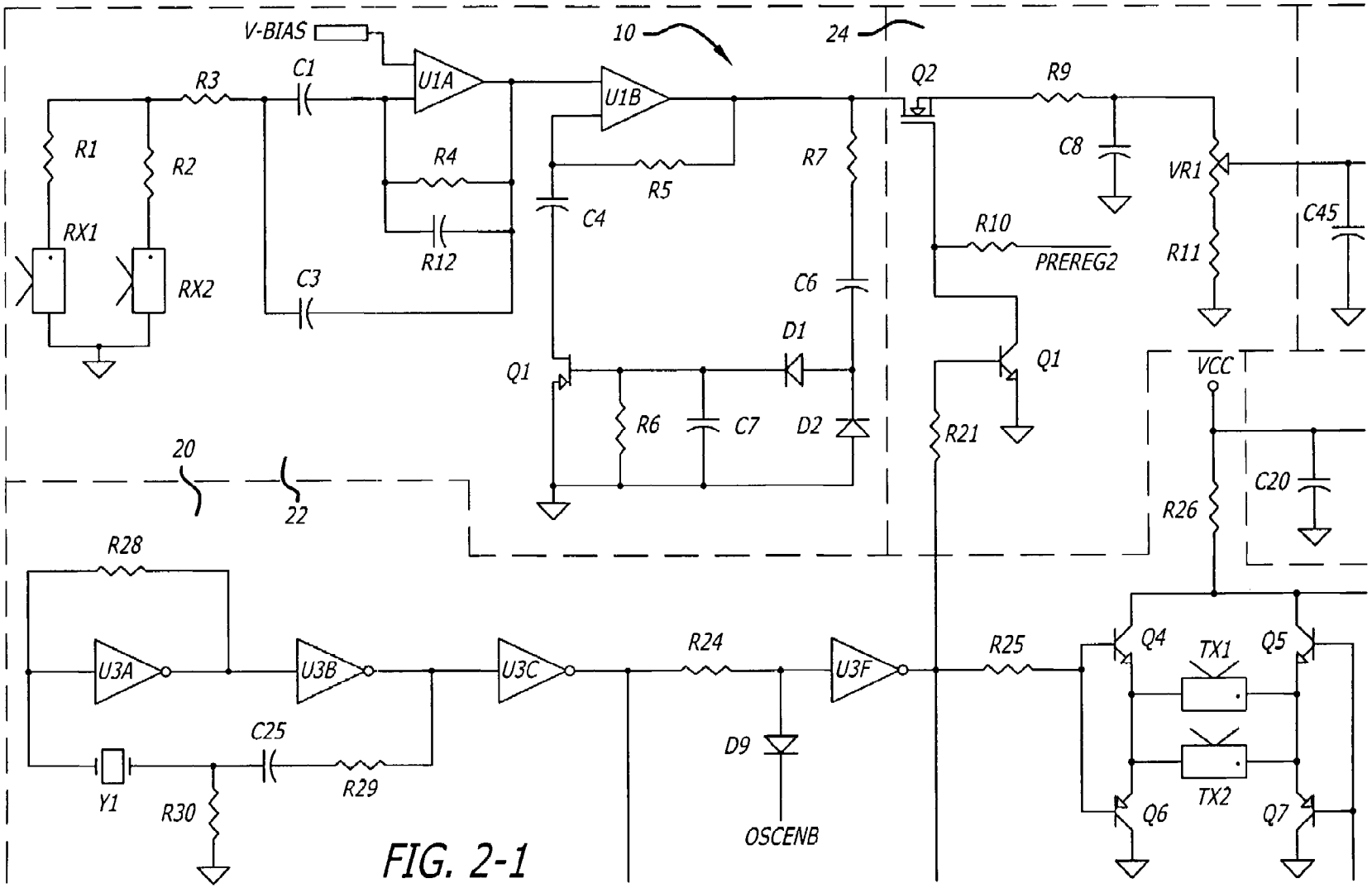
FIG. 2 is a circuit diagram of the occupancy sensor system.
Figure 2:
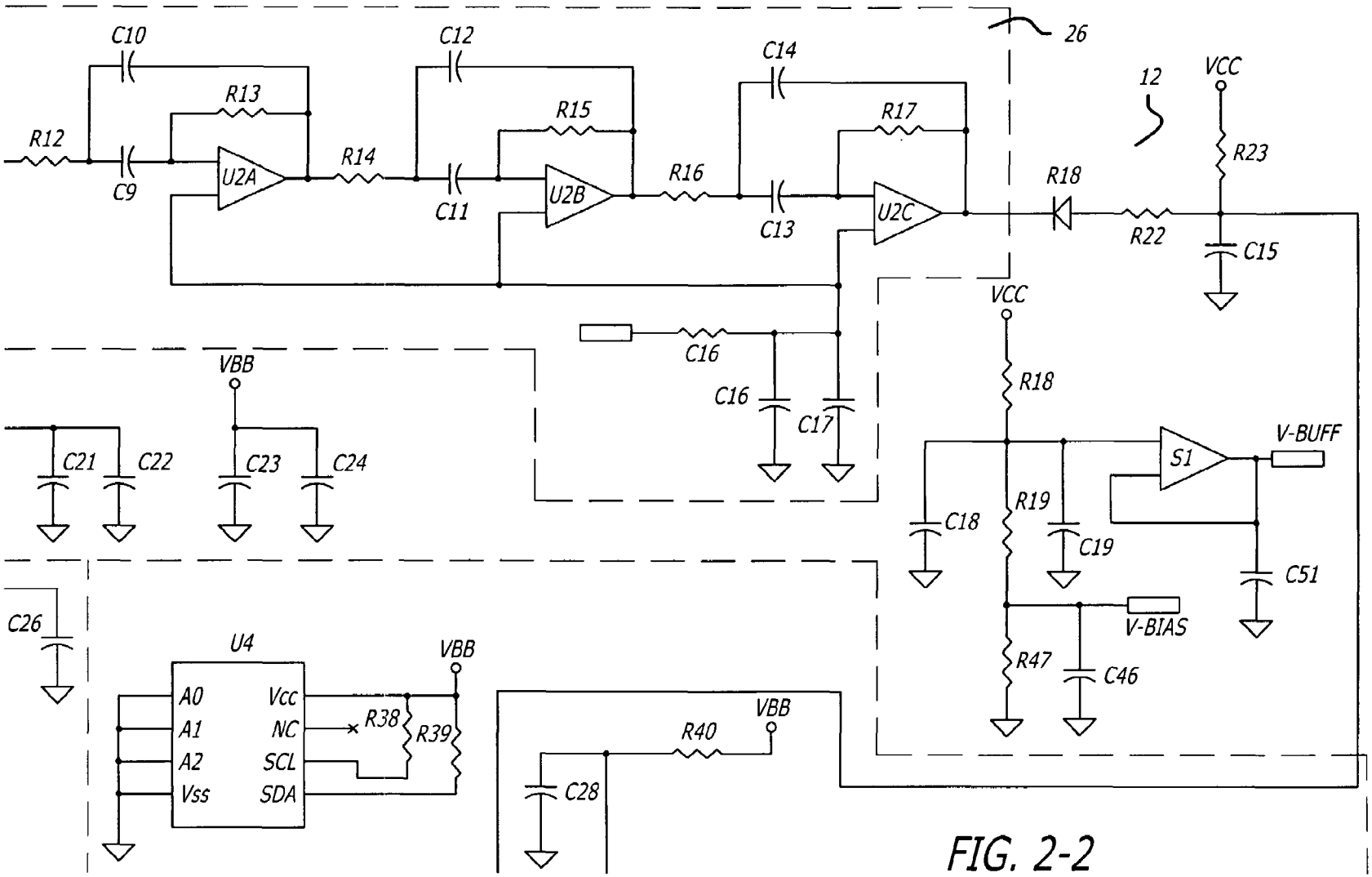

There is shown in FIG. 2 the occupancy sensor 12, for example, which includes a power supply 14. The power supply 14 provides the necessary voltages for the various other circuits. The incoming power may be between 10 and 30 VDC, at 25 mA for example. The power is able to be filtered such that clean regulated power is delivered to all sub-circuits within the device.

The occupancy sensor 12 further includes an infrared sensor section 16, which is able to passively sense occupancy of the area, and to activate a signal thereupon, to continue to activate the signal upon sensing the continuing occupancy of the area, to enable settings therefor, and to enable separate processing of the settings for only the infrared sensor section. It utilizes a passive technology, which does not send out a signal to aid in the reception of a signal. The occupancy sensor 12 also includes an ultrasonic sensor section 18, which is able to actively sense the occupancy of the area, to activate a signal upon sensing the continuing occupancy of the area, to include settings therefor, and to enable separate processing of the settings for only the ultrasonic sensor section. It utilizes an active technology, which sends out a reference signal which is compared to the received signal in order to determine if a change has occurred.

The occupancy sensor 12 is able to activate when the infrared sensor section 16 senses occupancy of the area, and to maintain activation when either the infrared sensor section 16 or the ultrasonic sensor section 18 senses continuing occupancy of the area. The signals in the infrared sensor section 16 and the ultrasonic sensor section 18 are each independently activated and form independent signals. The independent infrared section signal and the independent ultrasonic sensor section signal are not combined to form a composite signal. The occupancy sensor 12 is also able to maintain activation when both the infrared sensor section 16 and the ultrasonic sensor section 18 are independently activated and form independent signals.

The separately-processed settings comprise time delay settings and sensitivity settings. The separately-processed sensitivity settings include pre-programmed settings and self-adjusting settings. The separately-processed sensitivity settings of the ultrasonic sensor section further include an initial setting which is external to the pre-programmed settings. The pre-programmed sensitivity settings include baseline settings, and threshold trigger-acquiring settings comprising the amount of motion above the baseline settings required to trigger occupancy detection. The separately-processed time delay settings include pre-set settings and self-adjusting settings. The separately-processed settings include self-adjusting time delay settings and self-adjusting sensitivity settings, and the self-adjusting thereof comprises substantially moderate intermediate and incremental self-adjusting. The self-adjusting thereof is able to be responsive to real-time adjustment. The occupancy sensor further includes an element for detecting a fault in the operation thereof, and the self-adjusting thereof is able to be responsive to the fault detection. The self-adjusting is further able to be self-resetting. The time delay settings include a zero time delay setting for a system which is able to be connected to the occupancy sensor which includes an internal timing function.

The occupancy sensor 12 is also able to activate upon sensing motion in the area. The system 10 may further comprise a filtering element for filtering out the portion of the frequency spectrum related to air movement, for preventing false activation of the occupancy sensor. The system 10 may also include a motion-responding element for responding to motion varying from a baseline motion so as to require a constant level of such motion in order to activate the occupancy sensor. Also, the system 10 may include a building automation system relay, able to be connected to the occupancy sensor and a building automation system. Further, the system 10 may include a switch interface for enabling manual activation of the occupancy sensor such that the building automation system relay remains active during occupancy. The system 10 may further include an alarm relay, able to be connected to the occupancy sensor 12 and to an alarm system, and a setting element which may comprise a switch which is able to enable the selection of an alarm mode setting, and which is able to require multiple activations within a preset time period to activate the alarm relay. The system 10 is able to provide redundant detection testing so as to avoid false alarms.

The system 10 may further include a switch for enabling the setting of a manual-on mode of the occupancy sensor. The system may also include a push button interface which includes a push button switch for enabling initial activation of the occupancy sensor after the setting of the manual-on mode. The manual-on mode may comprise a time delay setting for the occupancy sensor 12, and the occupancy sensor 12 is able to automatically deactivate after manual activation following the time delay. Also, the system 10 may include a grace timer, able to automatically activate the occupancy sensor 12 within a grace period comprising a preset time after deactivation thereof. The system 10 may also include an automatic-on mode, which is able to be self-resetting. The self-resetting is such that upon manual setting of a lights turned-off setting, in the system automatic-on mode, the lights stay off during occupancy, and upon vacating the area and elapse of the time delay and grace period, the lights turn on automatically the next time the area is entered.

The system 10 is able to be connected to a system to be controlled thereby. The controlled system may comprise a lighting system, a heating system, and/or an air conditioning system. The system 10 may further include a switch, wherein the switch is further able to enable selection of a lighting sweep setting, to prevent false activation in a power sweep facility. The system may also include a setting element for enabling the input of a setting for the activating of the occupancy sensor 12, and a building automation system relay, able to be connected to the occupancy sensor 12 and a building automation system. The setting element may comprise a switch which is able to enable selection of the lighting sweep setting for the building automation system relay. Further, the system may comprise a setting element for enabling the input of a setting for the activating of the occupancy sensor 12, and an output control, able to be connected to the occupancy sensor 12 and an output control system. The setting element may comprise a switch which is able to enable selection of the lighting sweep setting for the output control system.

The system for sensing the occupancy of an area, which is able to activate upon sensing occupancy of the area, maintain activation when sensing continuing occupancy of the area, and enable self-adjusting of settings thereof, may alternatively comprise an occupancy sensor, able to activate upon sensing the occupancy of the area, to maintain activation when sensing continuing occupancy of the area, to include settings therefor, and to enable self-adjusting of the settings, including a motion-responding element for responding to motion varying from a baseline motion so as to require a constant level of such motion in order to activate the occupancy sensor. The system may, in another mode, comprise an occupancy sensor, able to activate upon sensing the occupancy of the area, to maintain activation when sensing continuing occupancy of the area, to include settings therefor, and to enable self-adjusting of the settings, including a building automation system relay, able to be connected to the occupancy sensor and a building automation system. It may alternatively comprise an occupancy sensor, able to activate upon sensing the occupancy of the area, to maintain activation when sensing continuing occupancy of the area, to include settings therefor, and to enable self-adjusting of the settings, including an alarm relay, able to be connected to the occupancy sensor and to an alarm system, and a setting element which comprises a switch which is able to enable the selection of an alarm mode setting, and which is able to require multiple activations within a preset time period to activate the alarm relay.

The system may further alternatively comprise an occupancy sensor, able to activate upon sensing the occupancy of the area, to maintain activation when sensing continuing occupancy of the area, to include settings therefor, and to enable self-adjusting of the settings, including a switch for enabling the setting of a manual-on mode of the occupancy sensor. Also, it may otherwise comprise an occupancy sensor, able to activate upon sensing the occupancy of the area, to maintain activation when sensing continuing occupancy of the area, to include settings therefor, and to enable self-adjusting of the settings, able to be connected to a system to be controlled thereby. It may still further comprise an occupancy sensor, able to activate upon sensing the occupancy of the area, to maintain activation when sensing continuing occupancy of the area, to include settings therefor, and to enable self-adjusting of the settings, including a switch, wherein the switch is further able to enable selection of a lighting sweep setting, to prevent false activation in a power sweep facility.

The system may still further alternatively comprise an occupancy sensor, able to activate upon sensing the occupancy of the area, to maintain activation when sensing continuing occupancy of the area, to include settings therefor, and to be connected to a system to be controlled thereby, wherein the occupancy sensor includes a building automation system relay, able to be connected to the occupancy sensor and a building automation system, and an interface which includes a switch which is able to toggle the state of the controlled system between on and off, wherein the switch is able to toggle the controlled system off while the building automation system relay remains active. It may also alternatively comprise an occupancy sensor, able to activate upon sensing the occupancy of the area, to maintain activation when sensing continuing occupancy of the area, and to include settings therefor, wherein the occupancy sensor includes a switch for enabling the setting of a manual-on mode, which comprises a time delay setting, and further includes an indicator which emits a visible indication of occupancy detection, and wherein switching to set the manual-on mode inhibits activation of the indicator in response to continued occupancy detection.

The infrared sensor section 16 generates an infrared signal which passes through a Fresnel lens. The signal then is AC coupled to a two-stage frequency limited amplifier prior to going into a microcontroller. The ultrasonic sensor section 18 includes an ultrasonic oscillator 20, wherein a carrier signal is produced, amplified, and then transmitted using ultrasonic transducers. It also includes an ultrasonic receiver 22, in which the signal is received using ultrasonic transducers, and is then amplified for further processing. To insure a constant signal, an Automatic Gain Control circuit may be utilized. When a person moves, the transmitter signal is distorted via a Doppler shift that is then interpreted as motion. The ultrasonic sensor section 18 further includes an ultrasonic demodulator 24, wherein the amplified receiver signal, which is a combination of the carrier signal and any motion signal that results, is separated into the motion signal and the carrier signal for further processing. It further includes an ultrasonic bandpass signal processing section 26, which further separates the motion signal from the carrier, and amplifies the portion of the spectrum that is of interest to help insure that the processed signal is that of a real motion as compared to a false motion.

The occupancy sensor 12 also includes a microcontroller 28, which includes supporting circuitry, and a DIP switch, which configures the product and its operation. A non-volatile memory is used to store the configuration and critical operating parameters in case of power failure, so the device will restart in its already optimized state. Also in this section are a bi-color LED indicator to show which half of the sensor detected motion, and a BAS/EMS relay and Switchpack control outputs.

Referring to FIG. 2, in the operation of the invention, the power supply 14, which includes voltage regulator IC's U6 and U7, regulates the incoming power of between 10 and 30 VDC at 25 mA, into two independent supplies of 5 VDC. To prevent damage from misconnection, diodes D6 and D10 insure that the voltage is the correct polarity. The combination of R6, C47, and C48 in the VBB supply provides filtering, primarily against 60 Hz noise, to the regulator. The combination of R46, C39 and C40 perform the same function for the VCC supply. The output of U6 is post filtered by C41 and C42, along with decoupling caps for the IC's connected to VCC. Capacitors C49 and C50 are used to post filter the VBB supply.

In the infrared sensor section 16, which includes a detector and an amplifier, including a detector DET1 which is a dual element passive pyro-electric detector, responds to light energy for example in the 8 to 14 micron range. The two elements are internally arranged to provide temperature stability. As a person moves within the field of view of the Fresnel lens, the infrared energy given off by the person's body heat causes a change in the amount of energy that is incident upon the elements of the detector, thereby creating a signal. The detector signal is filtered by the combination of R32 and C32, and is then AC coupled to amplifier U1C via capacitors C33 and C43. Adding resistor R34 sets the lower frequency limit. The upper frequency limit, and amplifier gain, is set by the combination of R35 and C34. A single amplifier may not provide sufficient gain to process the signal, so a second stage is used, and is set up the same as the first. The signal then proceeds directly to the microcontroller 28 for further processing.

In the ultrasonic sensor section 18, the ultrasonic oscillator 20 includes a crystal Y1 which sets the reference frequency. The crystal frequency is calibrated with resistors R29 and R30. Capacitor C25 is used to AC couple the crystal within the feedback loop. Inverters U3A and U3B are used to place the crystal into resonance, and resistor R28 is used to provide hysteresis for the first stage. Inverter U3C buffers the ultrasonic carrier signal. Inverters U3D and U3F are used to further buffer the signal and convert it into a 2-phase signal. The two phases are used to drive a push-pull amplifier made up of transistors Q4, Q5, Q6, and Q7. Filtered power is provided to the push-pull amplifier via resistor R26 and capacitor C26. The push-pull amplifier then sends the signal to the transmitting transducers TX1 and TX2, which convert the electrical signal into acoustic energy.

In the ultrasonic receiver 22, the outgoing ultrasonic signal is received by receiving transducers RX1 and RX2. The two signals are mixed via resistors R1 and R2 and then fed to the first of a two-stage amplifier circuit via resistor R3. Amplifier U1A is set up as a multiple feedback bandpass amplifier such that it will only amplify frequencies around the carrier frequency, which helps to eliminate problems from interference sources. The signal then proceeds to amplifier U1B which is a variable gain amplifier. The amount of gain is dependent upon the amount of signal present at the output of U1B. Components R7, C6, D1, D2, C7, R8, and Q1 form an AGC circuit to vary the gain as necessary to ensure the signal is always adequate for further processing.

In the ultrasonic demodulator 24, the ultrasonic transmitter signal is used as a reference signal via components R21, Q3, R10 and Q2. The transmitter signal is thereby connected to the gate of mosfet Q2. The ultrasonic receiver signal is connected to the drain of mosfet Q2. The signals are effectively beat together, which results in creating the sum and difference at the source lead of mosfet Q2. The source is then connected to a low pass filter, which eliminates the sum component only leaving the difference signal for further processing. The remaining signal is connected to voltage divider potentiometer VR1 that controls the amount of signal going into the bandpass circuit.

In the ultrasonic bandpass signal processing section 26, the demodulated motion signal is fed to the input of this circuit, which is a three stage, multiple feedback bandpass amplifier. Each stage further processes and amplifies the portion of signal that best determines a real motion as compared to interference signals such as those created by airflow or extraneous objects within the area being covered by the sensor. The two resistors and two capacitors within the feedback loop control the gain and Q of each stage for that stage, such as R12, R13, C9 and C10 for the first of the three stages.

In the microcontroller 28, which is shown in FIG. 2 as IC U5, and wherein the logic sequences are shown in the flow charts in FIGS. 3-12, components Y2, C27, and C29 set up a 10 MHz oscillator from which the microcontroller performs all of its timing functions. Internally, the chip divides the frequency by a factor of 4 such that it is running 2.5 million instructions per second.

There is shown in the flow charts in FIGS. 3-13, the application of the system 10, and the operation of the microcontroller 28, in accordance with the present invention.

Figures 2, 3:
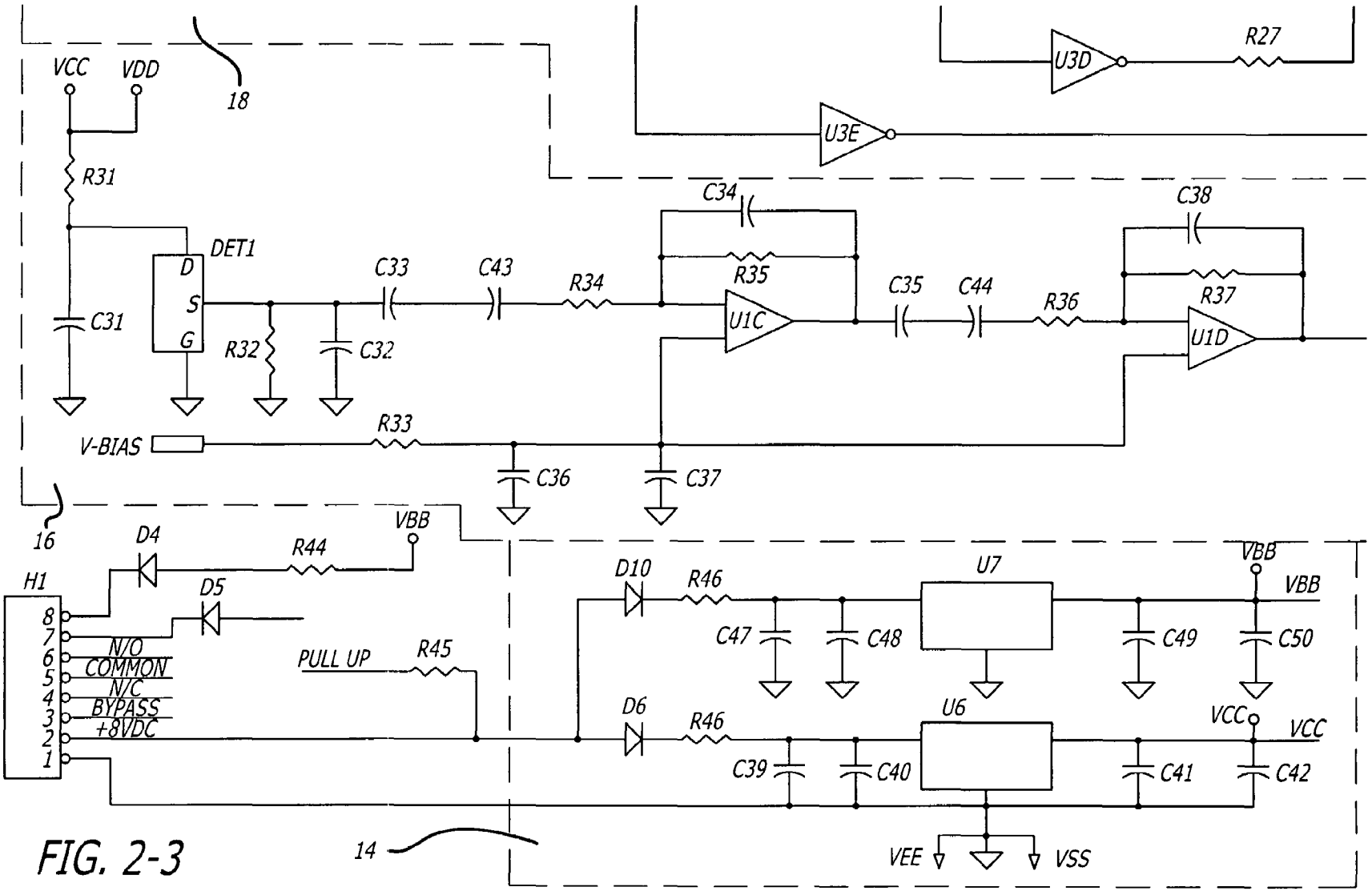
FIG. 3 is a flowchart illustrating system initialization.

FIG. 3 shows that, for initialization of the occupancy sensor 12, with respect to a "lighting sweep", some buildings disable the power to the entire lighting circuit including the sensors. Most sensors will activate when the sensor first has power applied due to the instability of the power supply during startup. The sensors herein have a preset delay, for example 50 seconds, in order for the unit to stabilize prior to being activated. In other installations, the sensor power is controlled by the toggle switch in the room, wherein it would be inconvenient to wait the 50 seconds prior to the lighting being activated; therefore this feature is DIP switch selectable. A "manual on" mode for the ceiling sensors may be selected by the DIP switch, which allows the user to install a momentary switch that initially activates the lights, and the sensor will automatically deactivate the lights. A grace timer, of for example 10 seconds, may also used for safety purposes. If neither of these options is selected, the lights may be immediately forced on, and the initialization may proceed. Critical operating parameters may be restored from the non-volatile memory and the checksum may be verified. If the checksum is not valid, the memory may be initialized.

Figures 2, 3, 4:
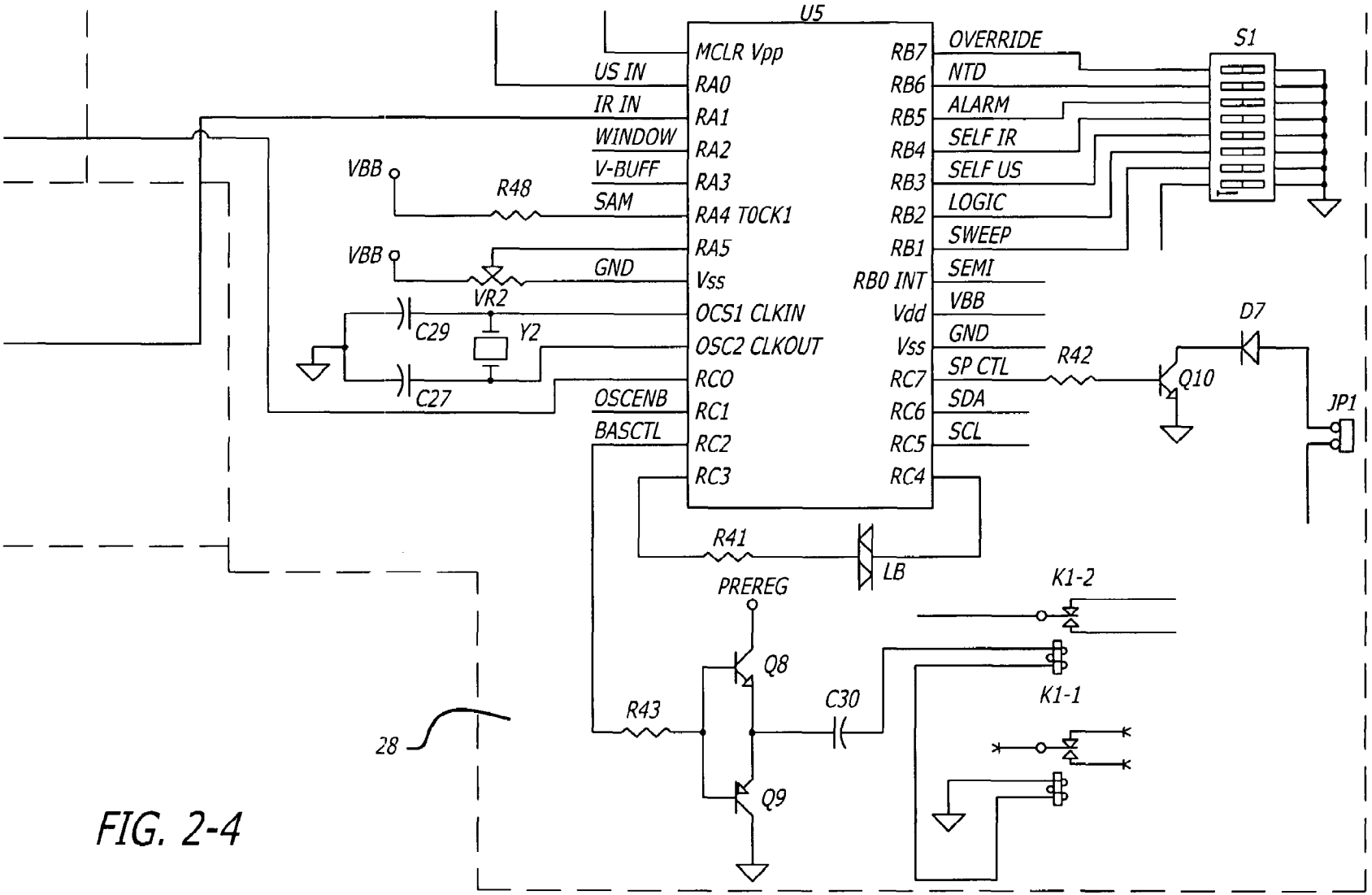
FIG. 4 is a flowchart of the main loop of the system.
Figure 3:
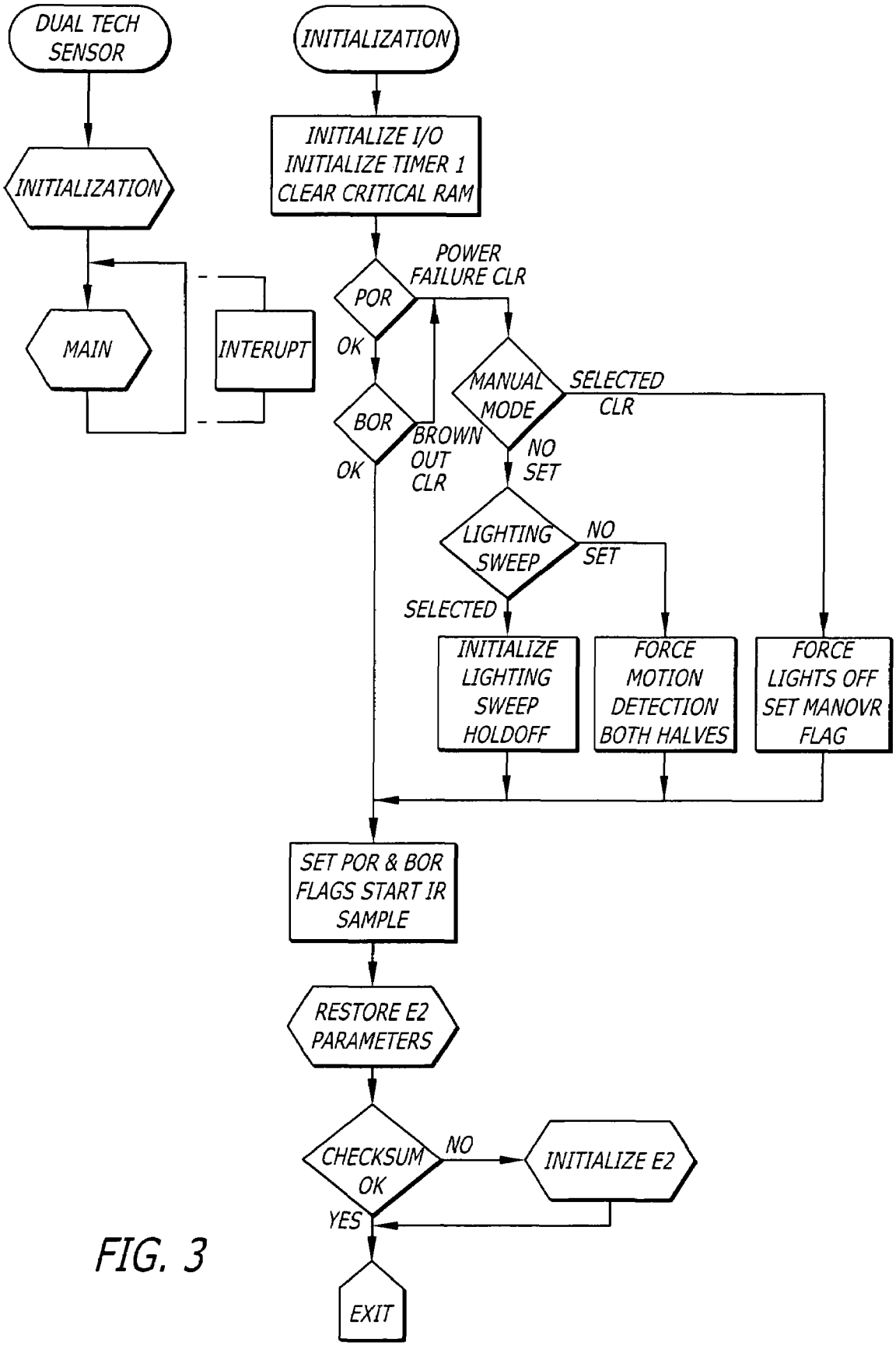
Figures 1, 4:
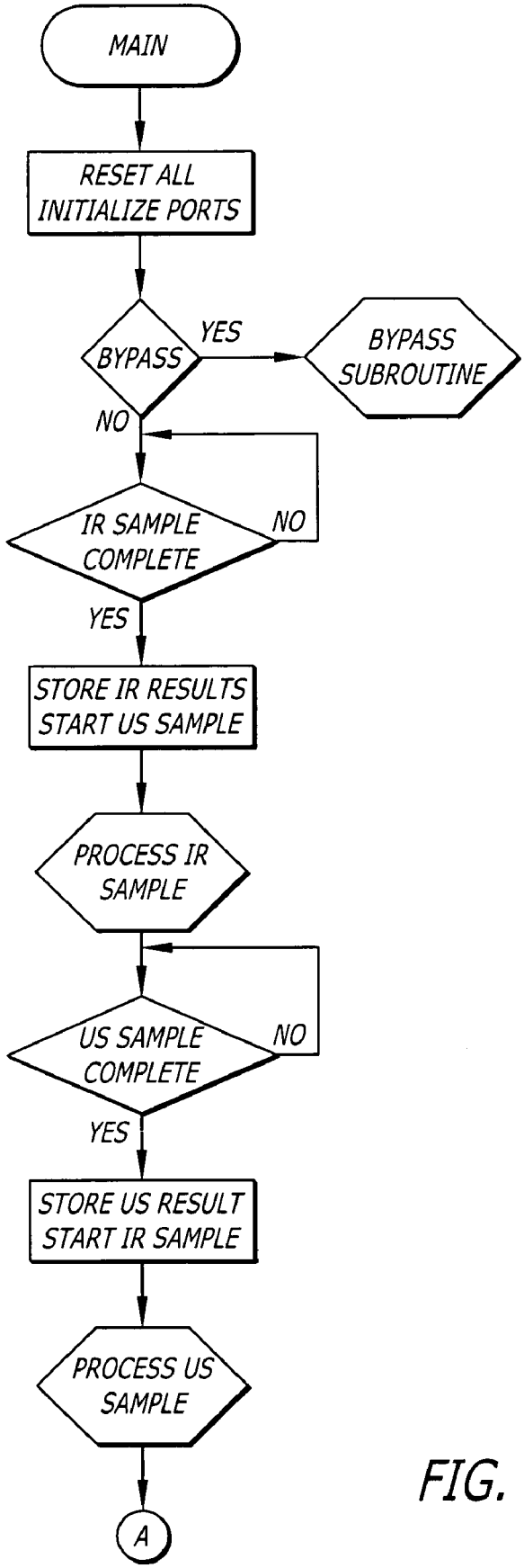
Figures 2, 4:
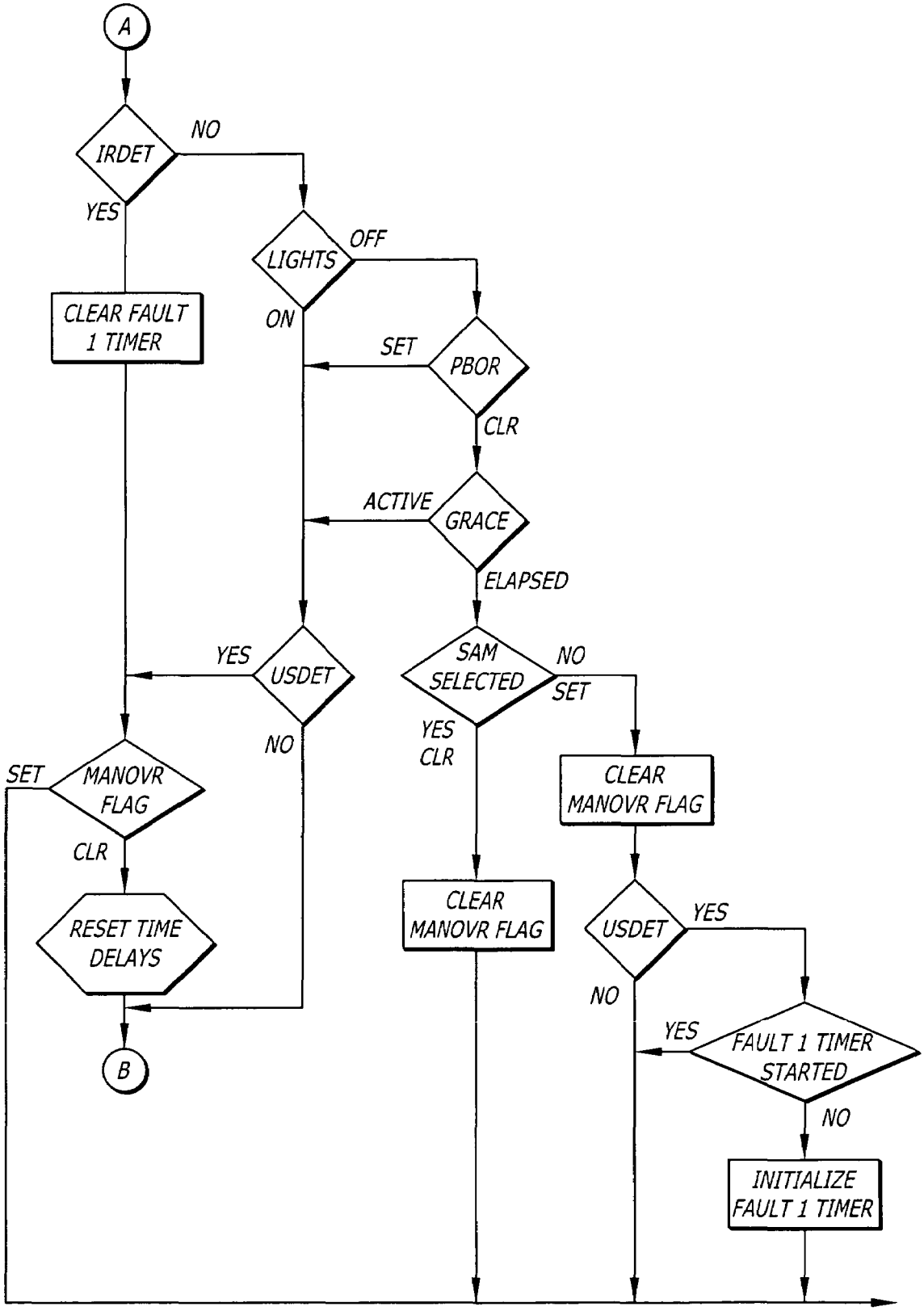
Figures 3, 4:
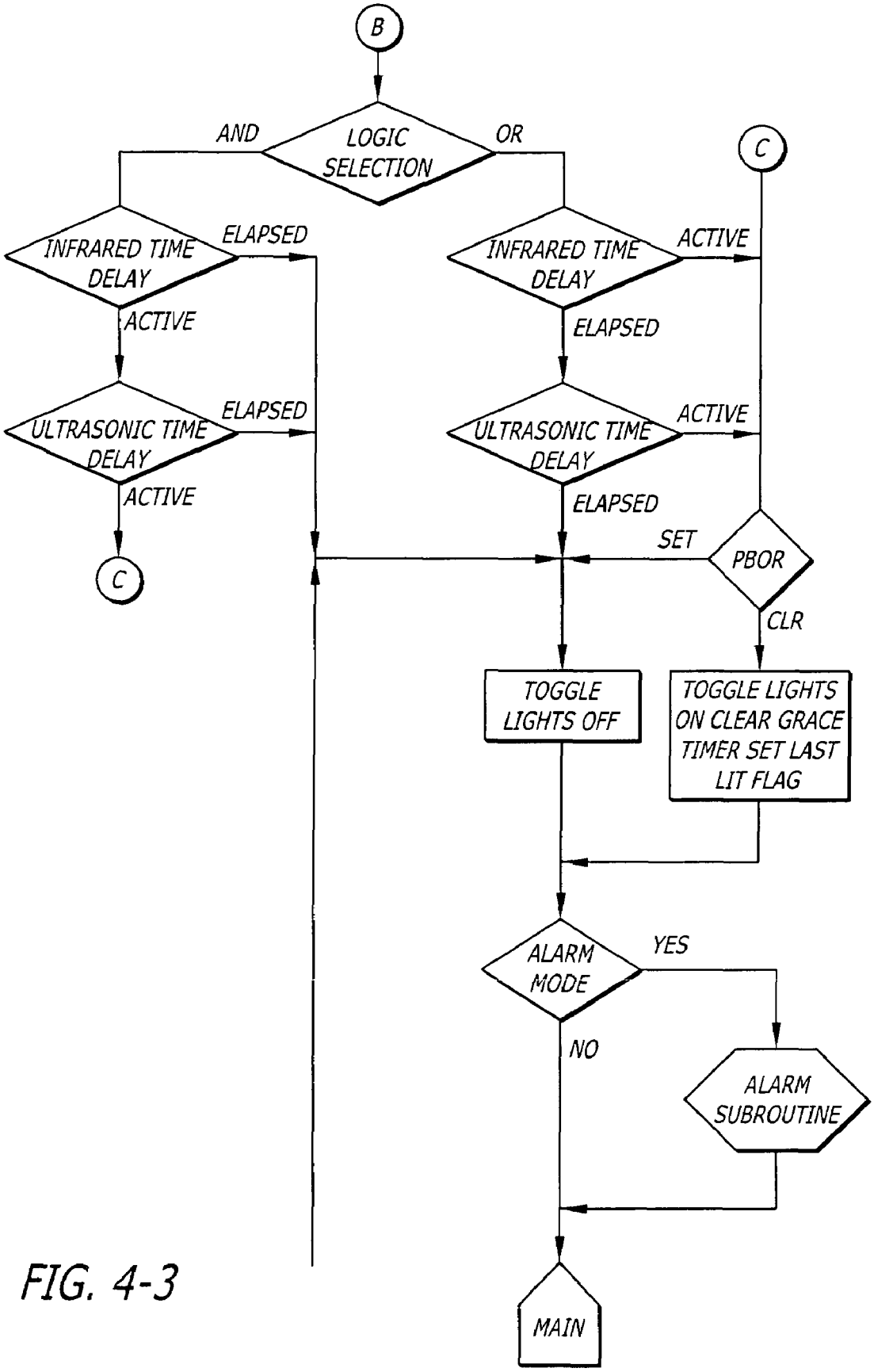

FIG. 4 illustrates the main loop of the program. In order for the program operation to remain robust, the I/O ports are initialized within each loop. The bypass DIP switch is checked to see if it has been selected, if not the program proceeds. The infrared input is sampled, and then while it is being processed the ultrasonic input is sampled. This process alternates to improve the sample rate of the two inputs. The decision tree is also shown to determine if the lights should be activated or deactivated, and to test if the DIP switch for the "alarm mode" has been selected in which case it executes the alarm routine.

Figures 1, 5:
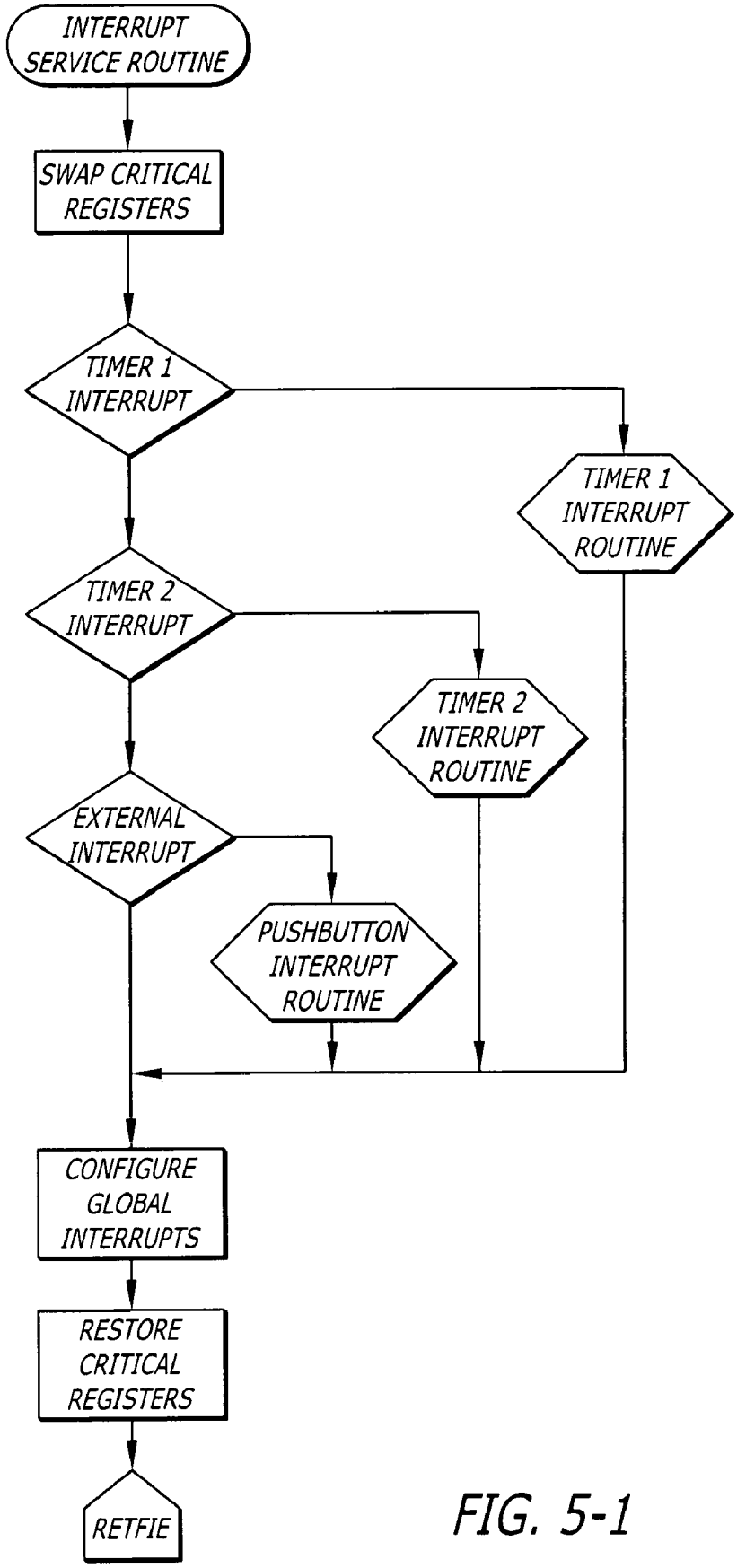
FIG. 5 is a flowchart of the interrupt routines of the system.
Figures 2, 5:
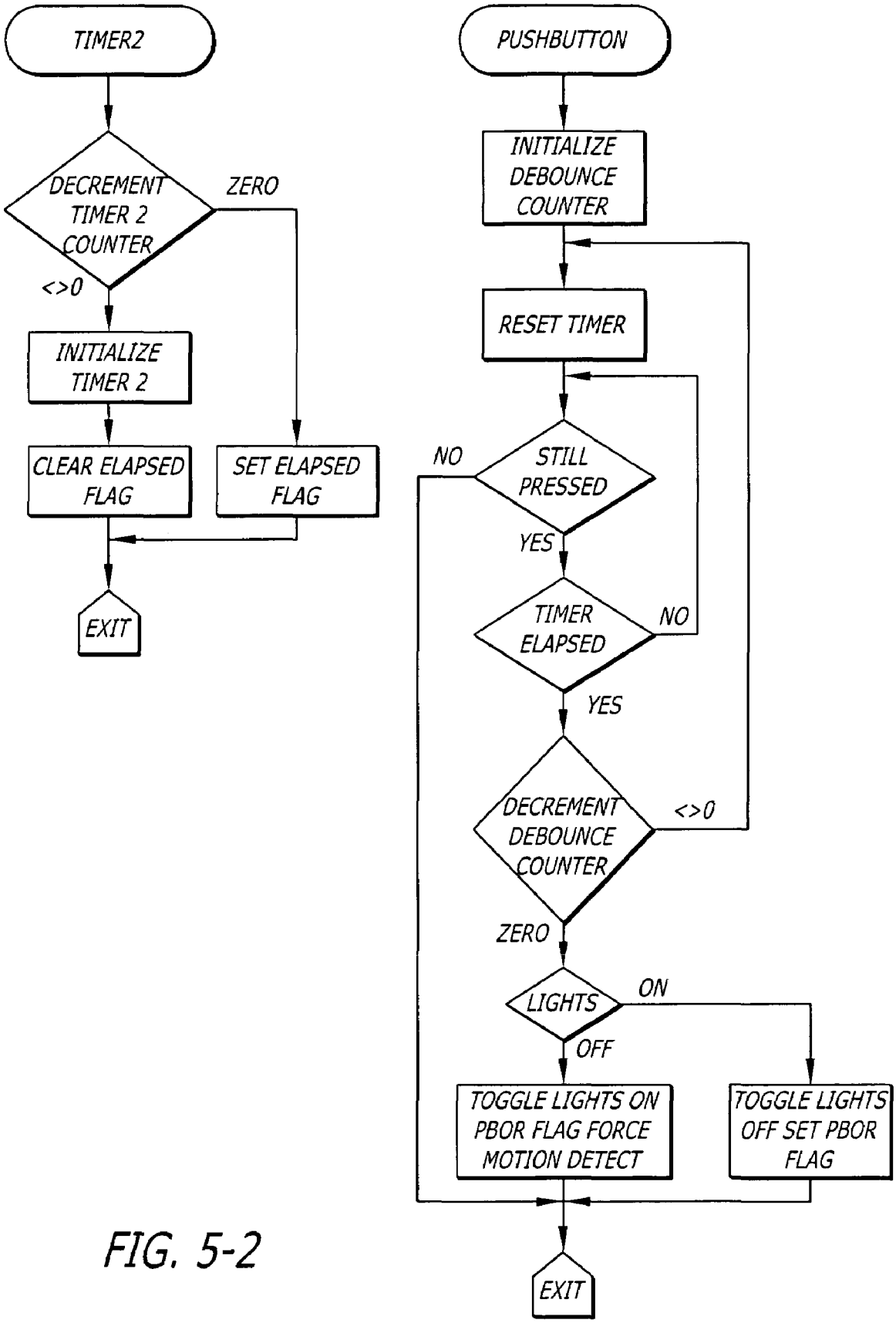

As seen in FIG. 5, for the interrupt routines, all available interrupts may not be used, and the external interrupt which is connected to the momentary switch and the timer interrupts may be used. The routine tests for which interrupt occurred, and then executes the corresponding routine, then reinitializes the interrupts. The momentary switch may be used at any time, even if the manual on mode is not selected. Also the debounce routine may be built into the interrupt service routine.

Figures 1, 6:
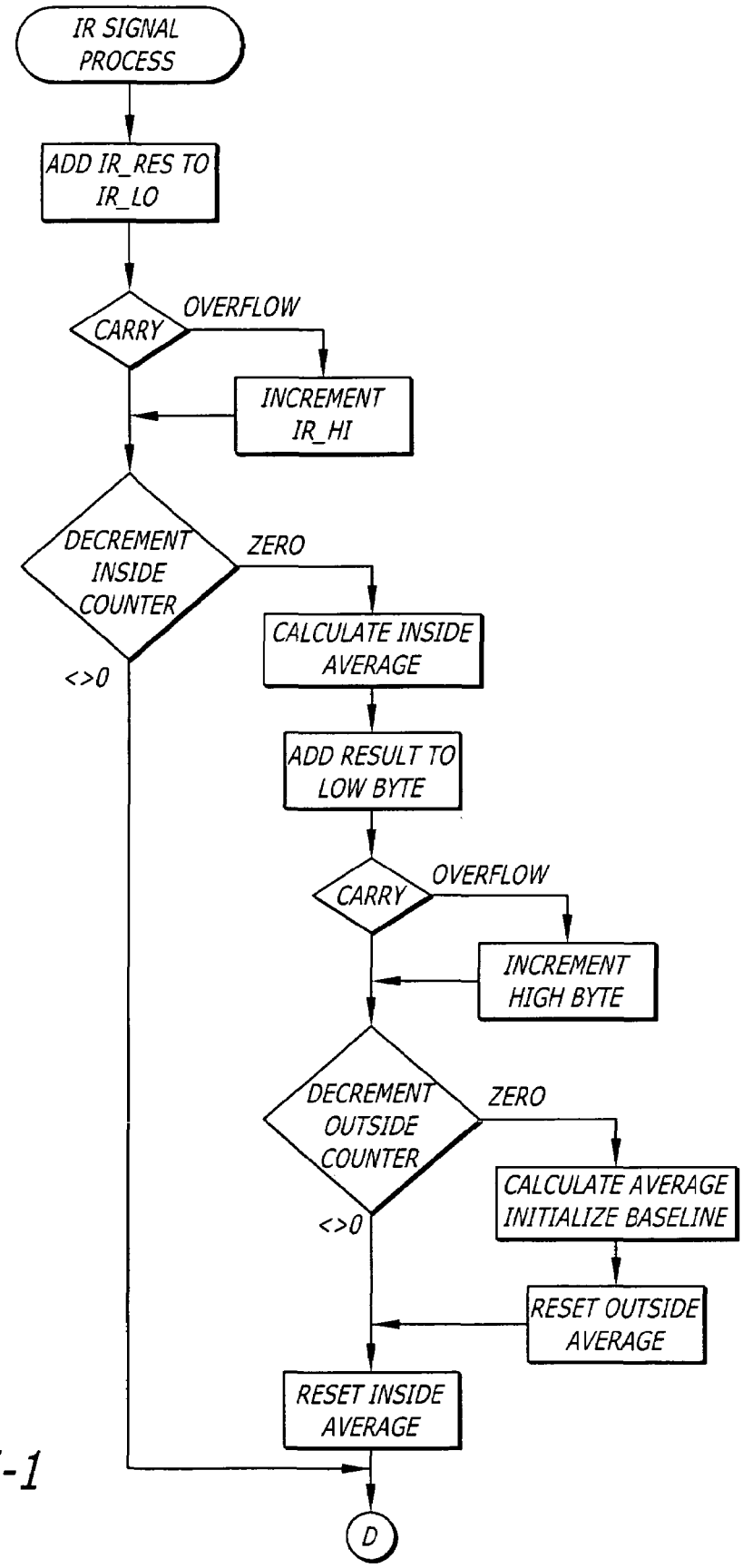
FIG. 6 is a flowchart showing the infrared signal processing.
Figures 2, 6:
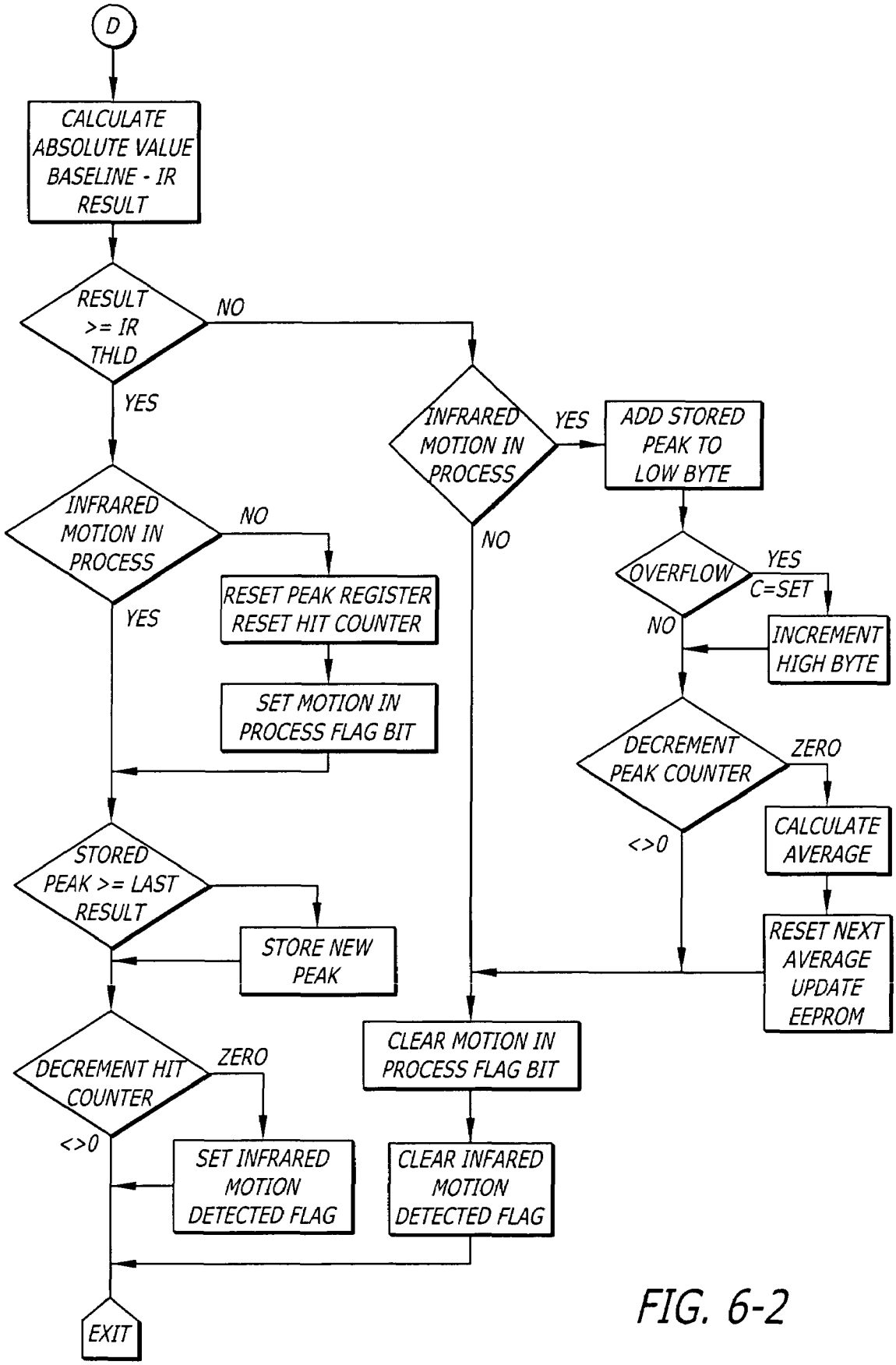

FIG. 6 shows that the infrared signal may be processed, so as to include the averaging routine, which performs real time baseline adjustments. A firmware version of a "rate of change comparator" may be implemented. By knowing the sample rate, the rate of change may be controlled very accurately. The absolute value between the signal level and the baseline may be used to determine if the signal indicates a motion. Infrared signals can deflect in either direction from the baseline; therefore the absolute value calculation becomes important. A minimum duration of valid signal is then verified along with monitoring the peak level of the motion signal. If the duration requirement is not satisfied, all flags are cleared and the motion must start over.

Figures 1, 7:
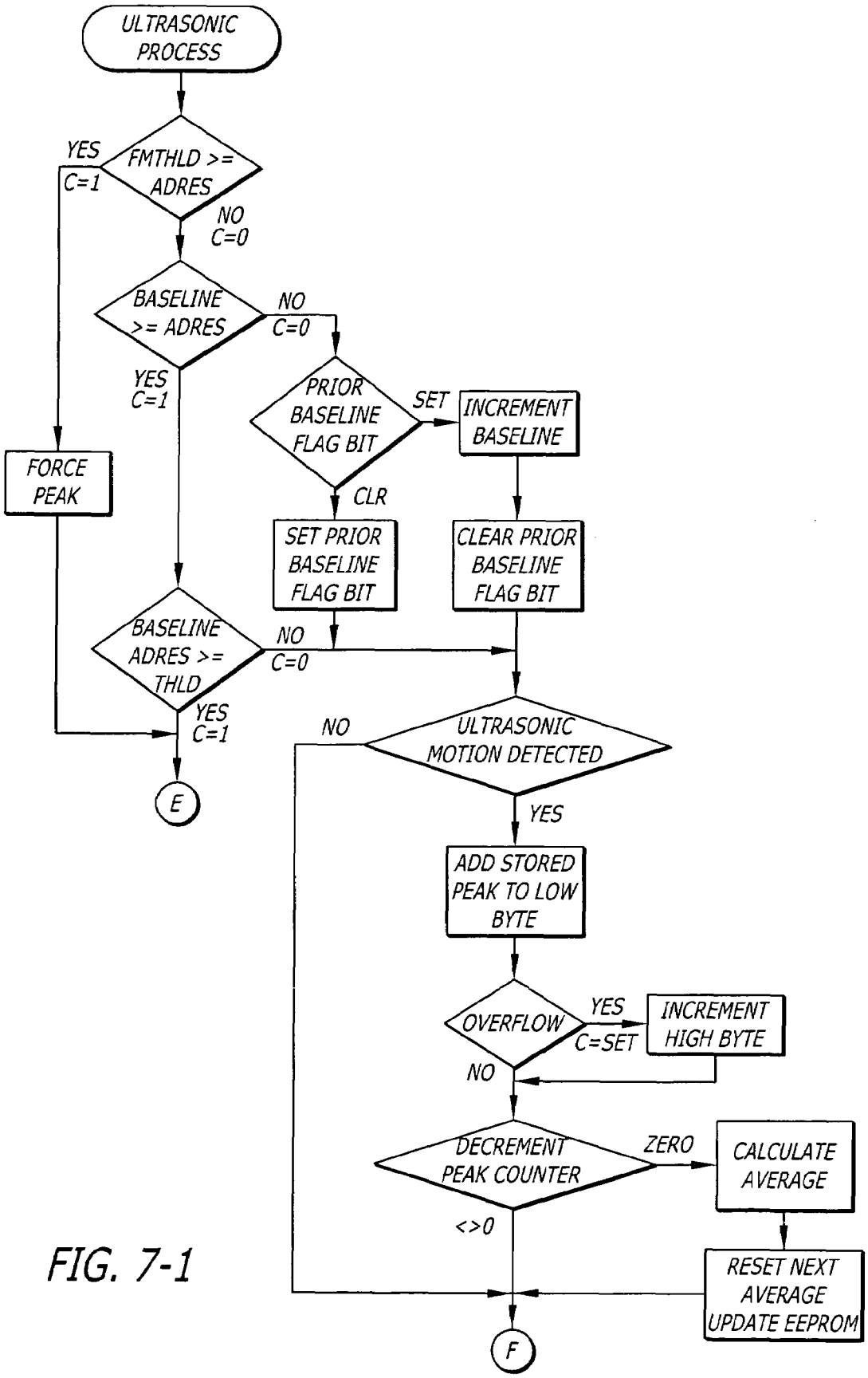
FIG. 7 is a flowchart of the ultrasonic signal processing.
Figures 2, 7:
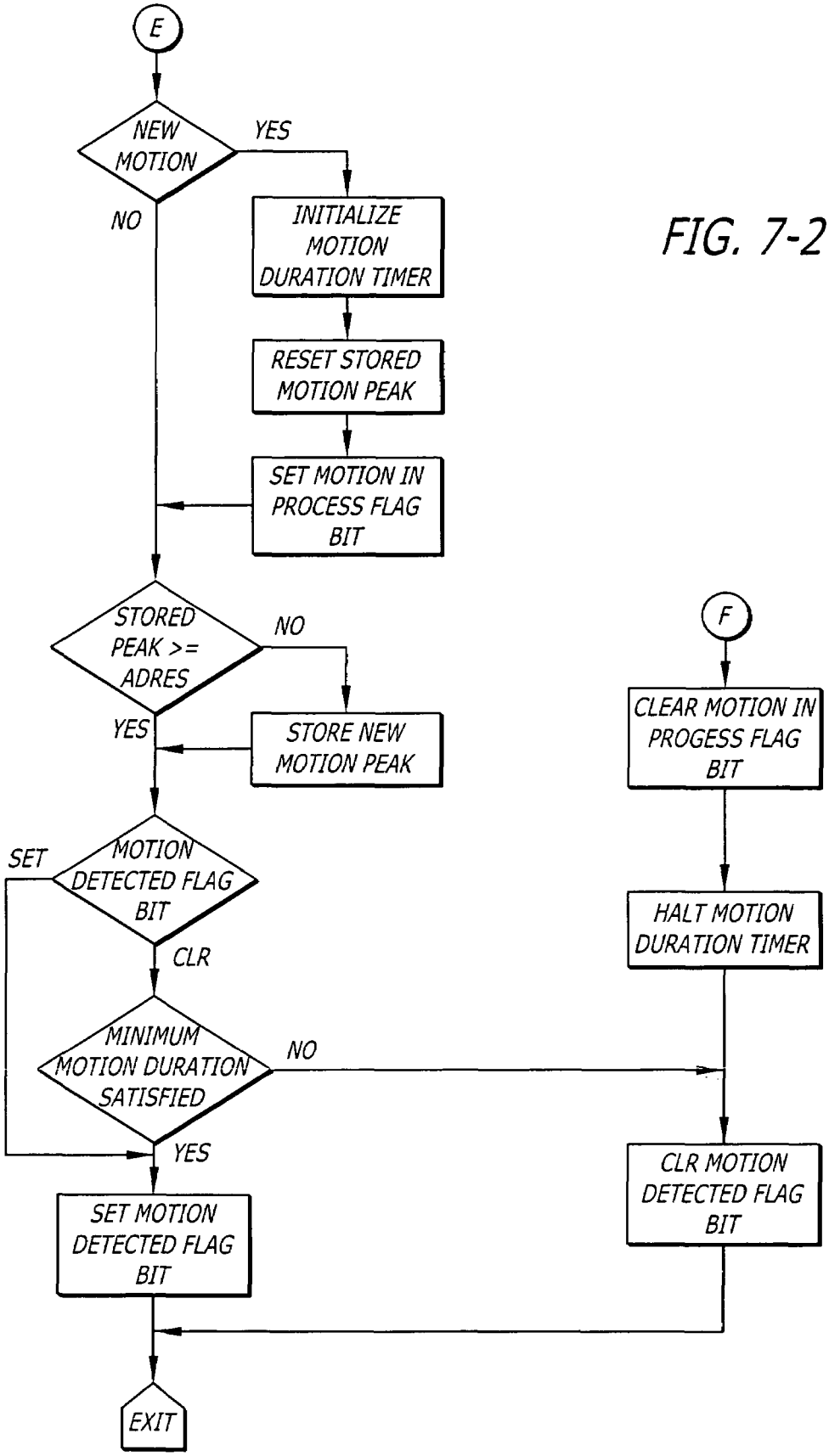

In FIG. 7, the ultrasonic signal processing is shown, including the real time baseline calculation and adjustment. Ultrasonic motion signals only deflect in one direction, therefore the baseline becomes the average undeflected signal level. Via a motion duration timer, the remainder of an "airflow tolerant technology" is implemented within the firmware. The peak motion level may be monitored and recorded, along with the average motion level.

Figures 1, 8:
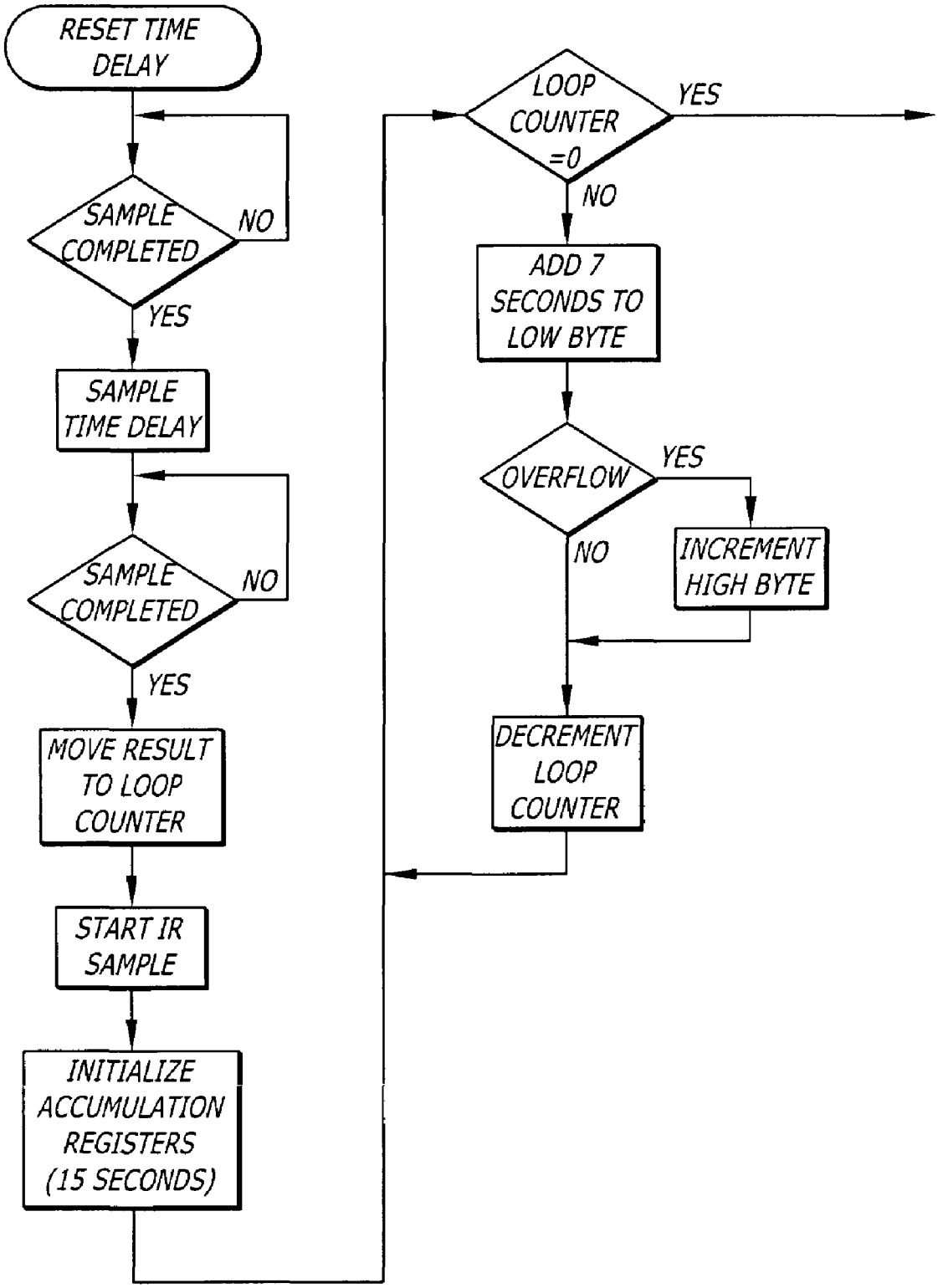
FIG. 8 is a flowchart of the time delay resets.
Figures 2, 8:
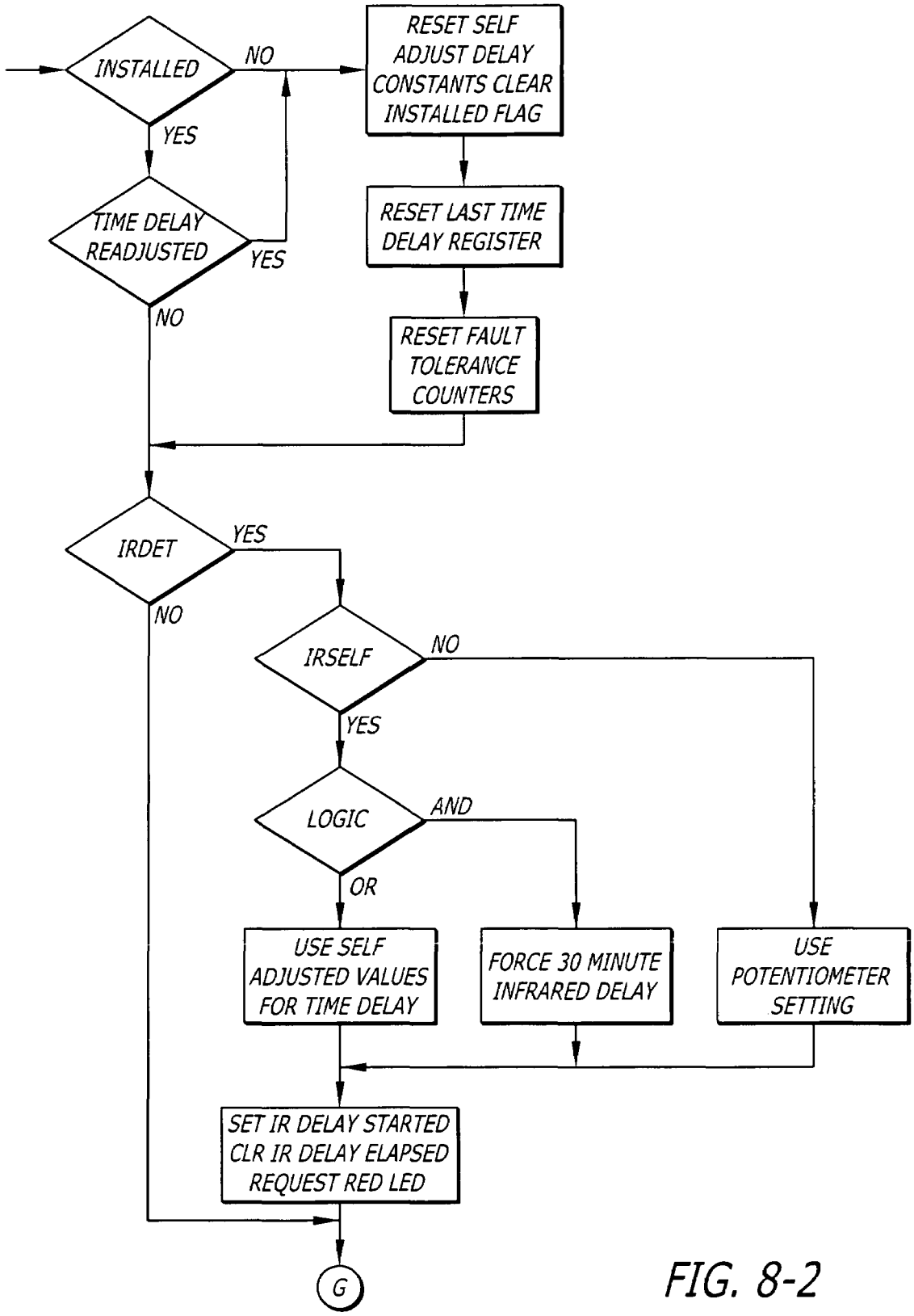
Figures 3, 8:
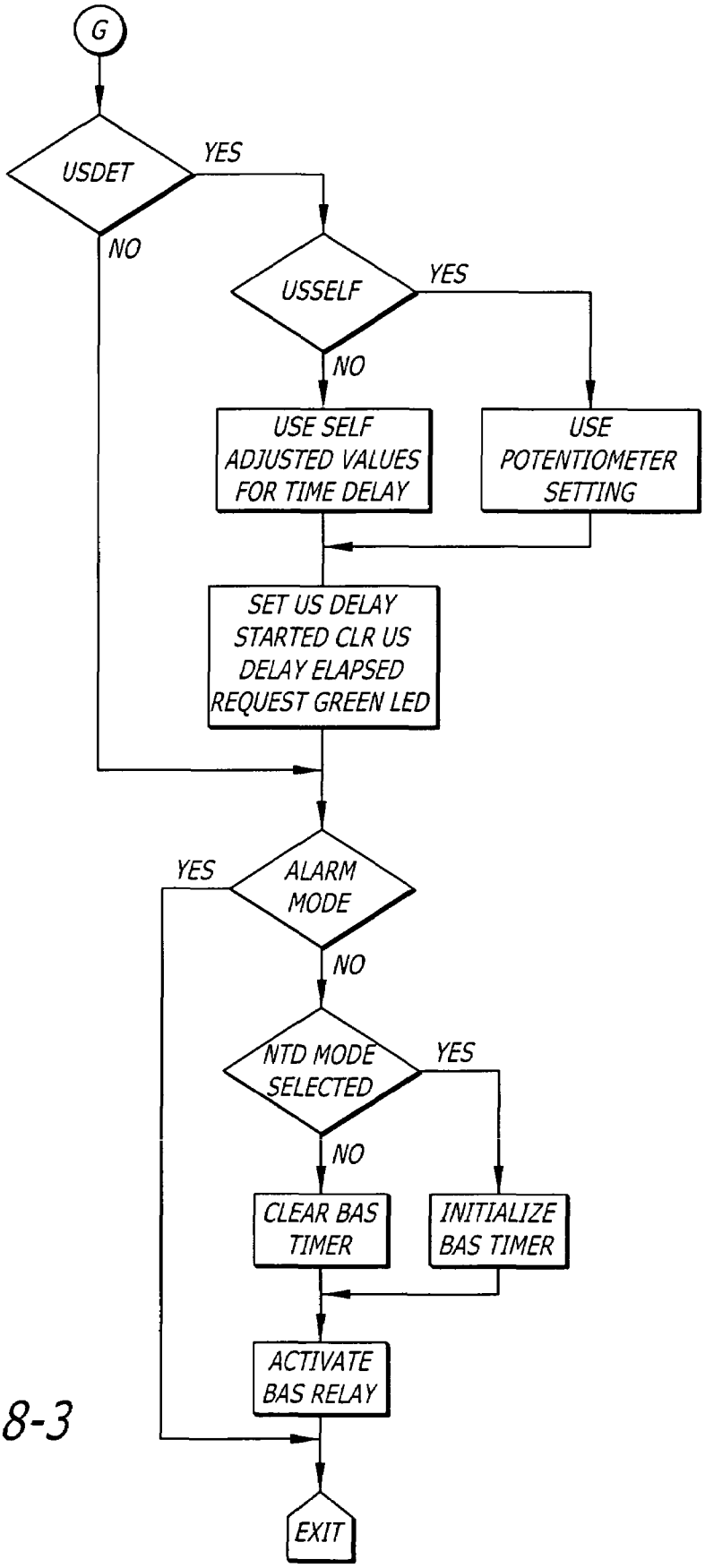

With respect to FIG. 8, the time delay resets are shown. The ultrasonic and infrared sections of the occupancy sensor 12 may have independent time delays. When motion is detected, only the appropriate half is reset. This device uses an installation timer that will not allow the device to do any self-adjusting prior to the installation being complete. Once the device is off for a period for example of one hour, the installation timer may be satisfied and the non-volatile memory may be updated such that the installation timer only has to occur once. Also, after the installation timer has elapsed, if the potentiometer is accidentally left to a setting of for example less than 5 minutes, the self adjust settings may be automatically setup to a starting point of for example 10 minutes. The sequence is shown of the time delay potentiometer setting being measured and used in a loop to accumulate the time delay to the appropriate duration. If the installation timer is not elapsed or if the time delay has been readjusted, the device will reset all the self-adjusting parameters and update the non-volatile memory. It then checks for motion detection of each half of the sensor and verifies that the self-adjusting has not been disabled for that half by the appropriate DIP switch. If the DIP switch is set to "both mode" for maintaining the lights, the infrared delay is forced to a setting of for example 30 minutes. This routine is only called when it is valid to reset the delay(s). As such, this routine also controls the BAS relay output. If not in "alarm mode", the DIP switch is tested that selects a zero time delay option for the BAS relay, and activates it for example for only one second if selected. Otherwise it is controlled along with the lighting.

Figures 1, 9:
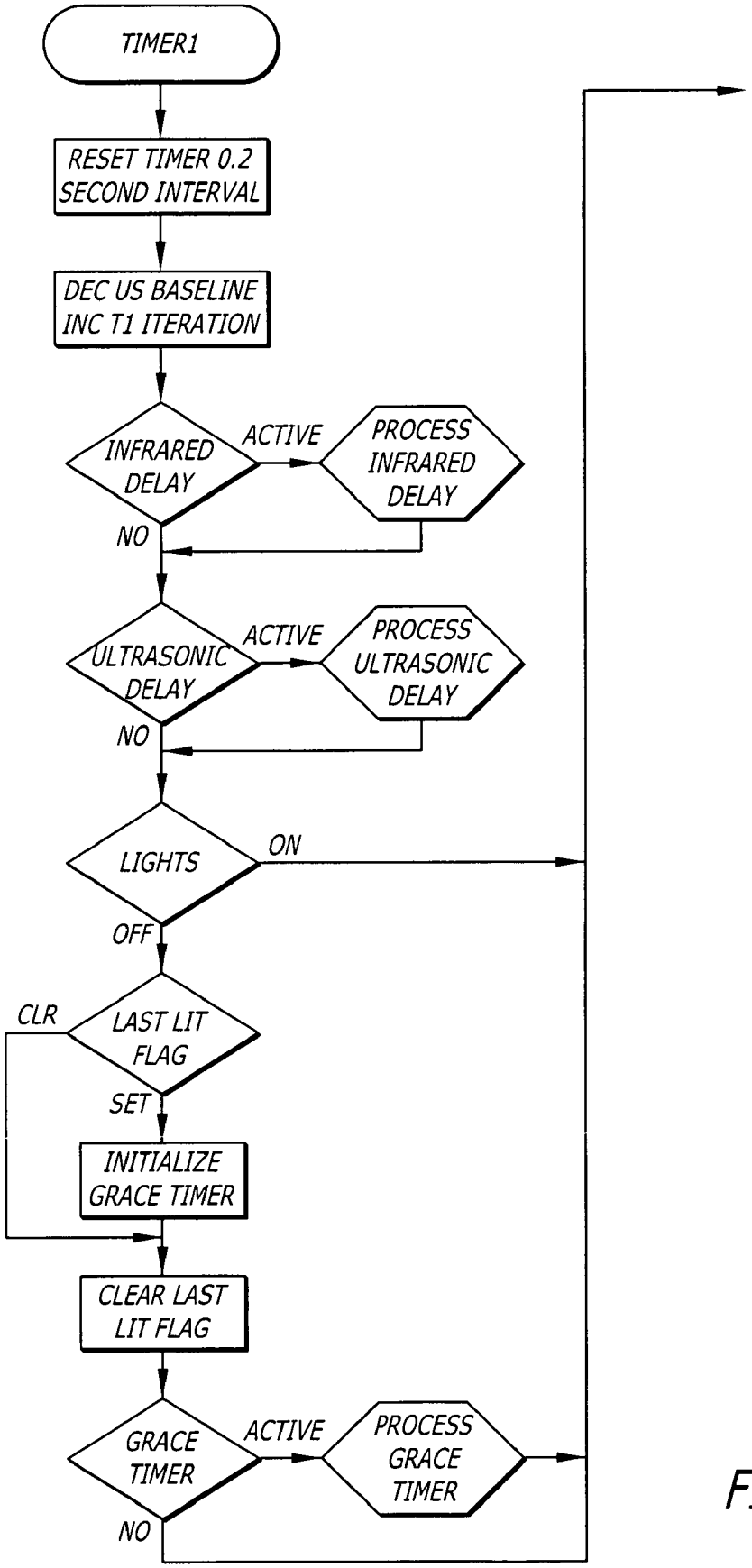
FIG. 9 is a flowchart of a timer interrupt function.
Figures 2, 9:
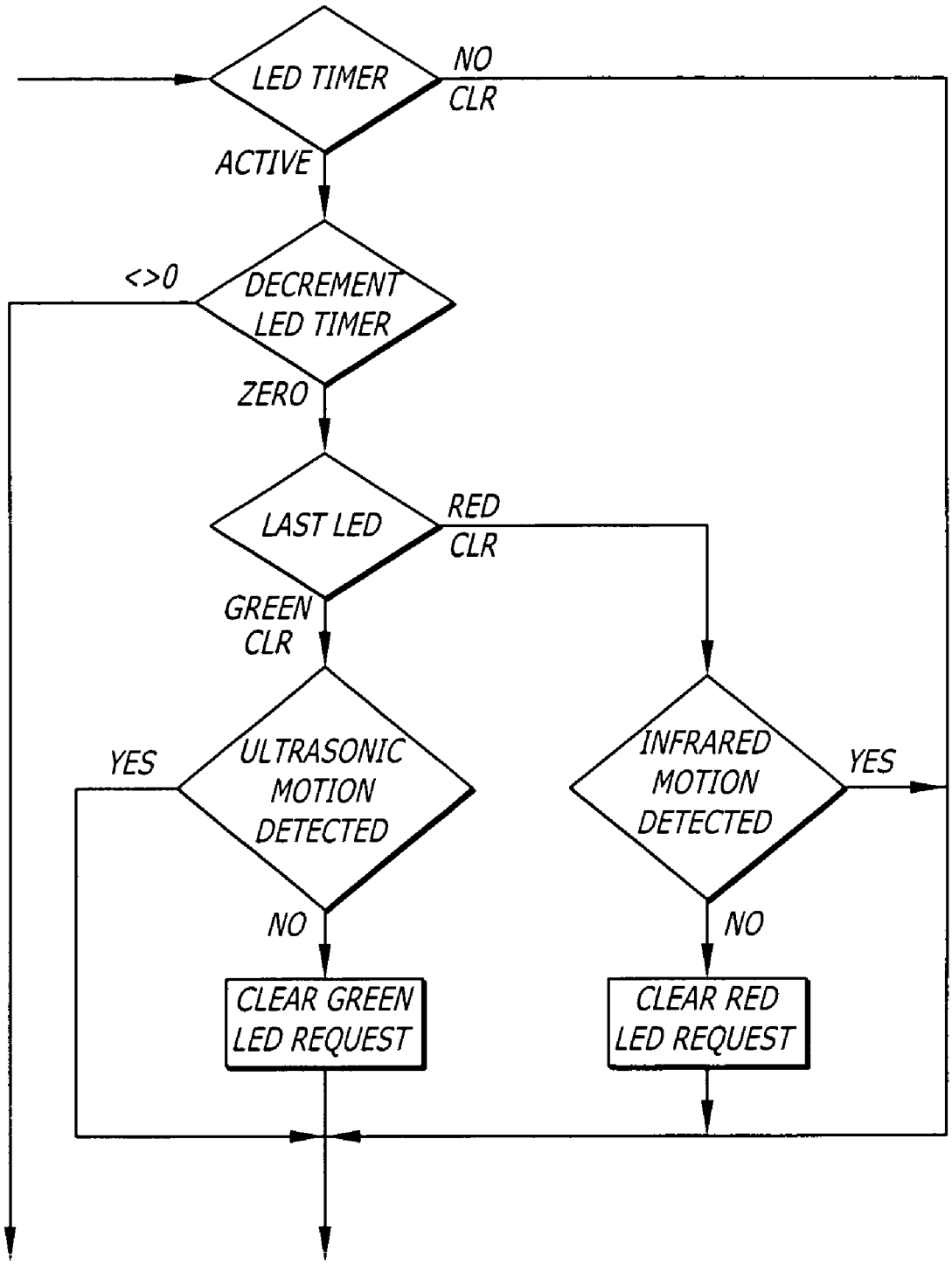
Figures 3, 9:
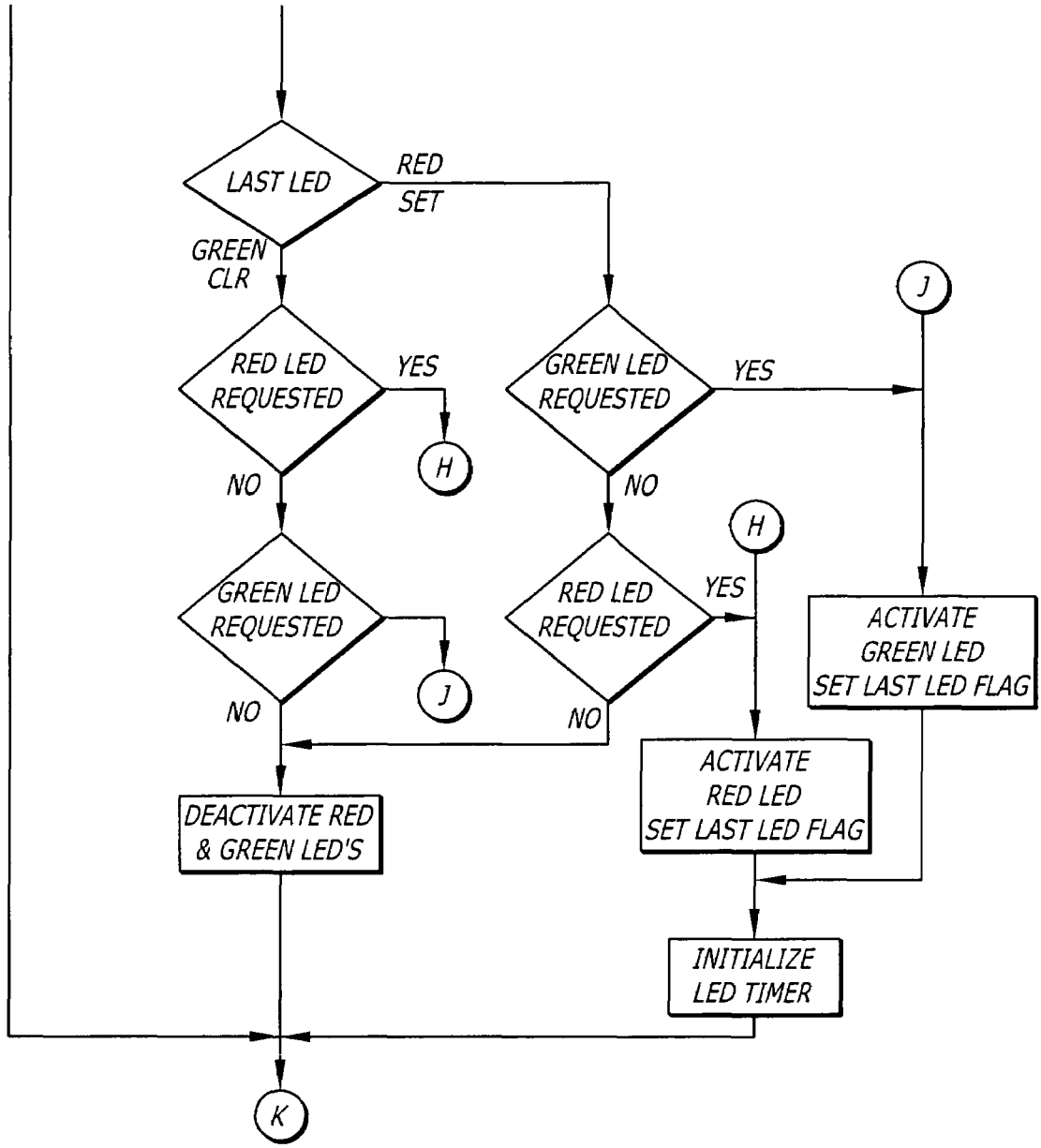

Referring to FIG. 9, the flow chart shows how a timer 1 interrupt performs many time based functions built into the sensor. Timer 1 may be internally setup to cause an interrupt every 0.2 seconds. With each interrupt, a small offset if forced into the ultrasonic baseline such that the real time self-adjusting will always be correct. The timing functions achieved through the use of timer 1 include the infrared time delay, the ultrasonic time delay, the grace timer, the LED timer, the BAS/EMS relay timer, all the alarm timers, fault timers which track the duration that the lights are on or off, and the one hour installation timer.

Figures 1, 10:
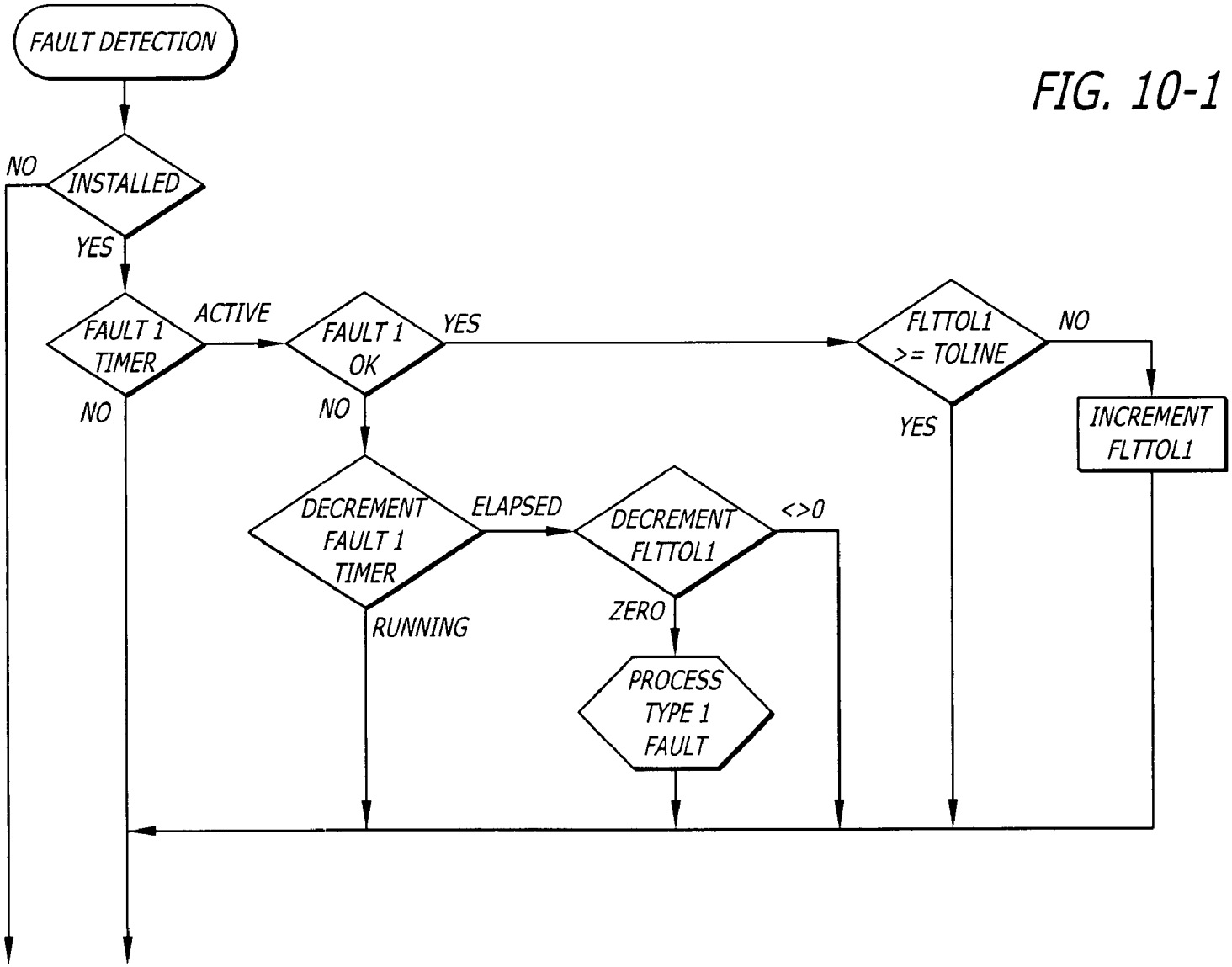
FIG. 10 is a flowchart which shows the fault detection.
Figures 2, 10:
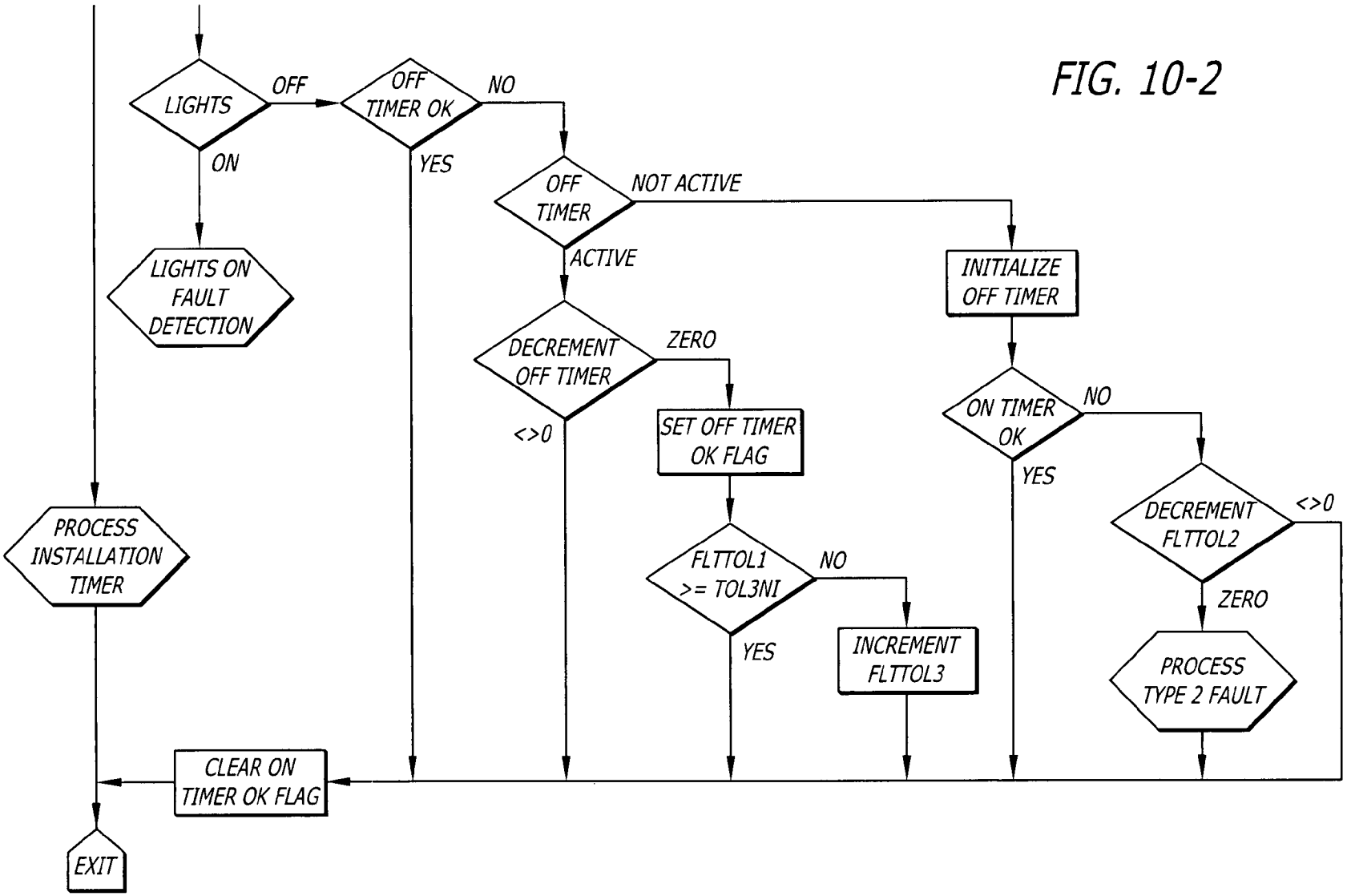

FIG. 10 shows how the fault detection works. When a fault is confirmed, an adjustment may be made to either the time delay or sensitivity threshold of the infrared or ultrasonic section of the sensor. No fault detections will occur until the installation timer is elapsed. There are three types of fault that can be detected. The first (Fault 1) is possible since the device is designed to activate only upon an infrared motion detection. Therefore when the lights are off, if the ultrasonic half of the sensor detects a motion a short duration timer is started (for example approximately one minute). If that timer elapses without the infrared half detecting a motion, the ultrasonic half of the sensor had a false detection. If this fault is detected multiple times (for example twice), the ultrasonic threshold is adjusted such that the ultrasonic half is less sensitive. The second type of fault (Fault 2) occurs when the lights turn on again after being off for only a short time (for example about 30 seconds) which indicates a false off. Again if the fault occurs multiple times (for example twice), then an adjustment is made to increase either time delay or sensitivity.

Figure 11:
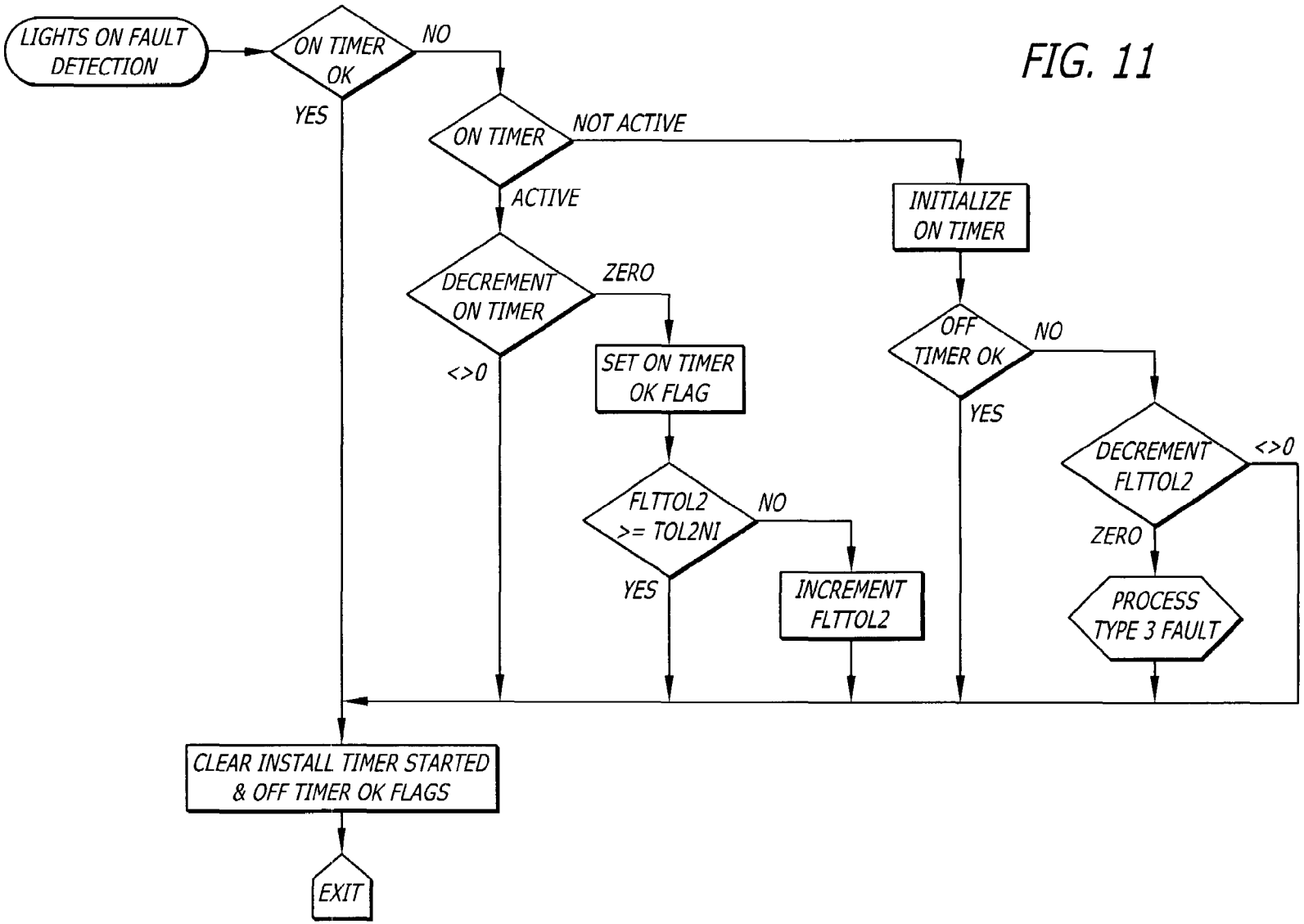
FIG. 11 is a flowchart of the fault adjustments.

FIG. 11 shows how the lights on fault detection is triggered. The third type of fault (Fault 3) occurs when the lights activate and then deactivate after only one time delay indicating a false on. As with the others, if this occurs multiple times (for example twice) then an adjustment is made to decrease the sensitivity.

Figures 1, 12:
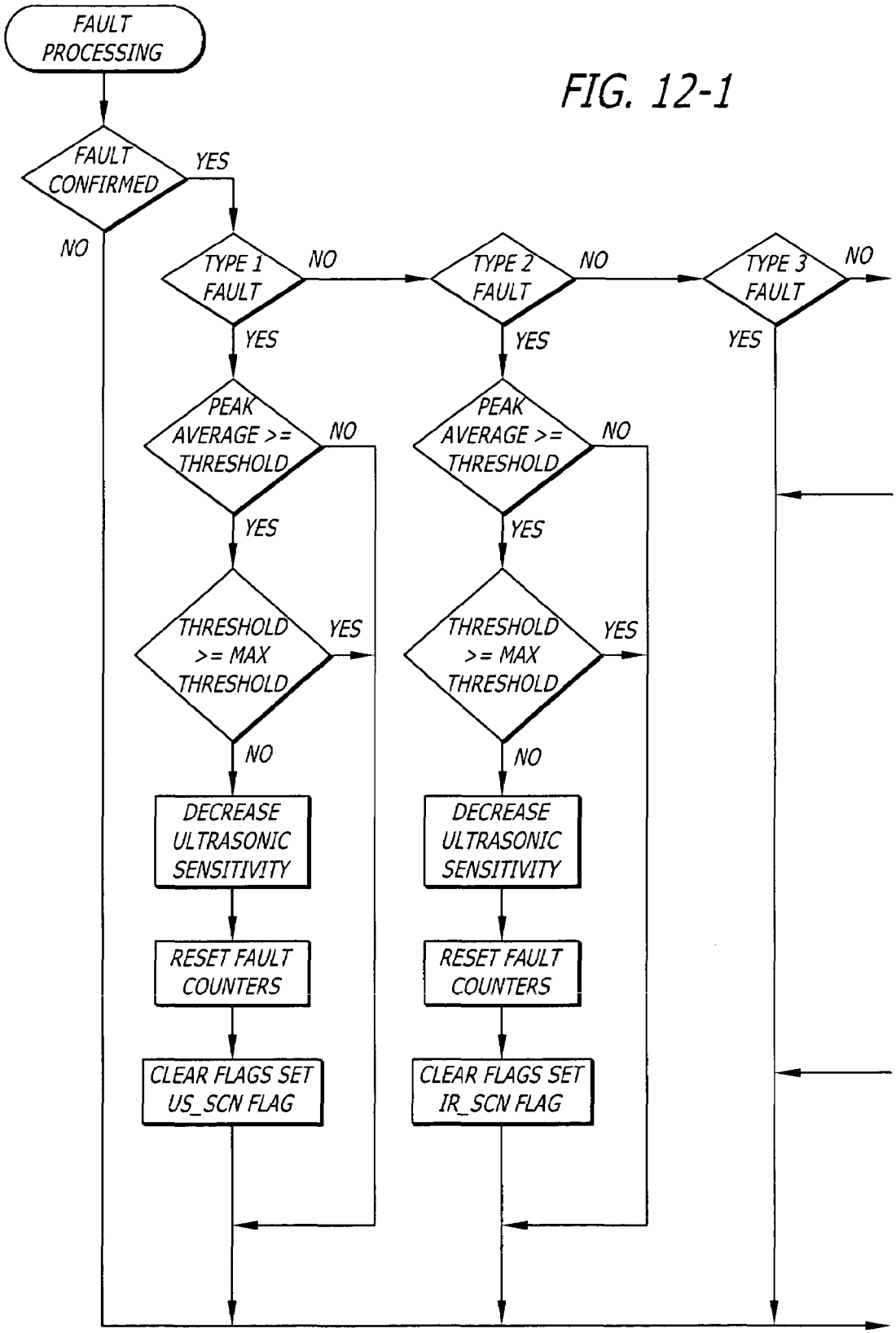
FIG. 12 is a flowchart illustrating the non-volatile memory routines.
Figures 2, 12:
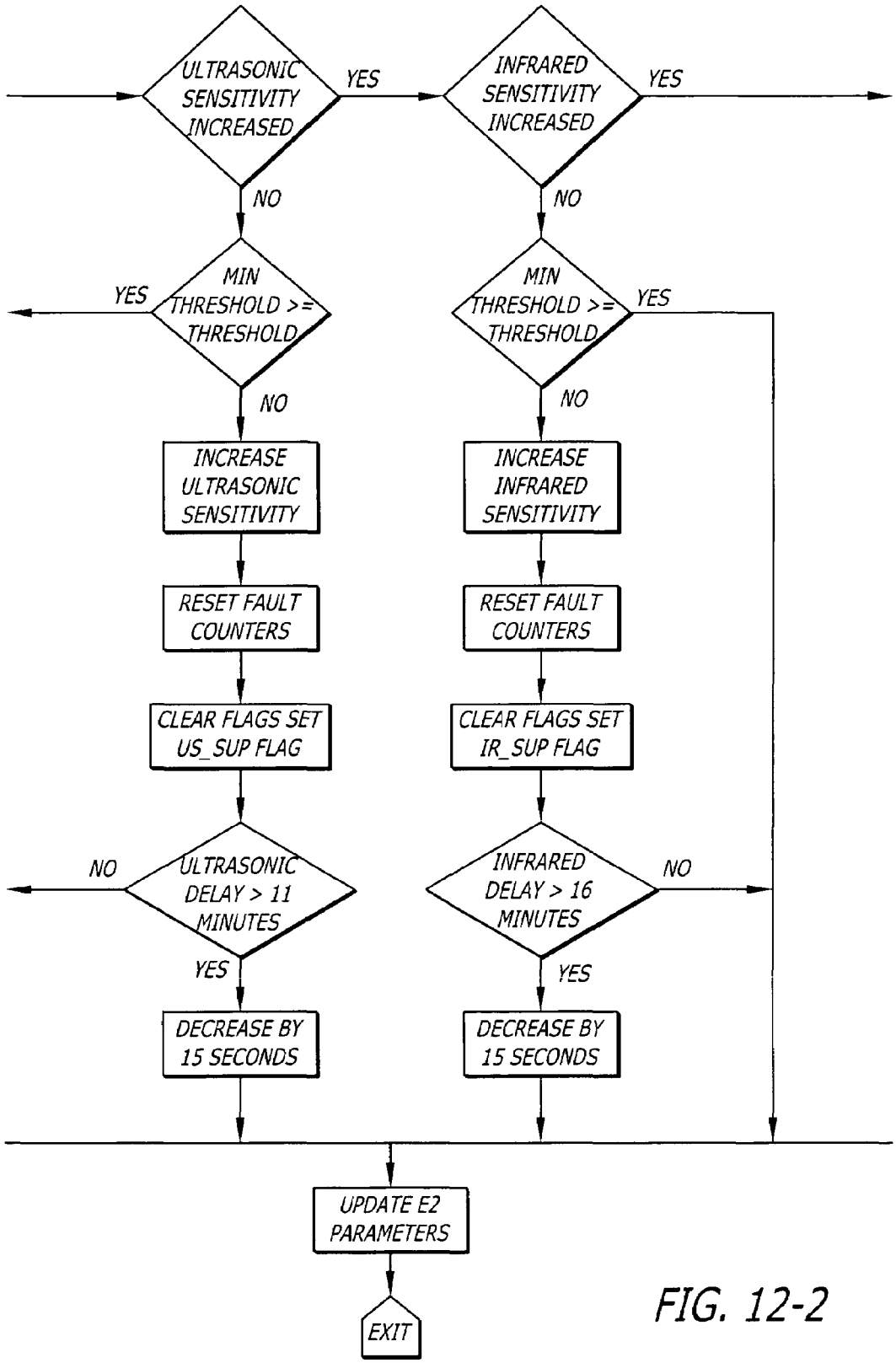
Figures 3, 12:
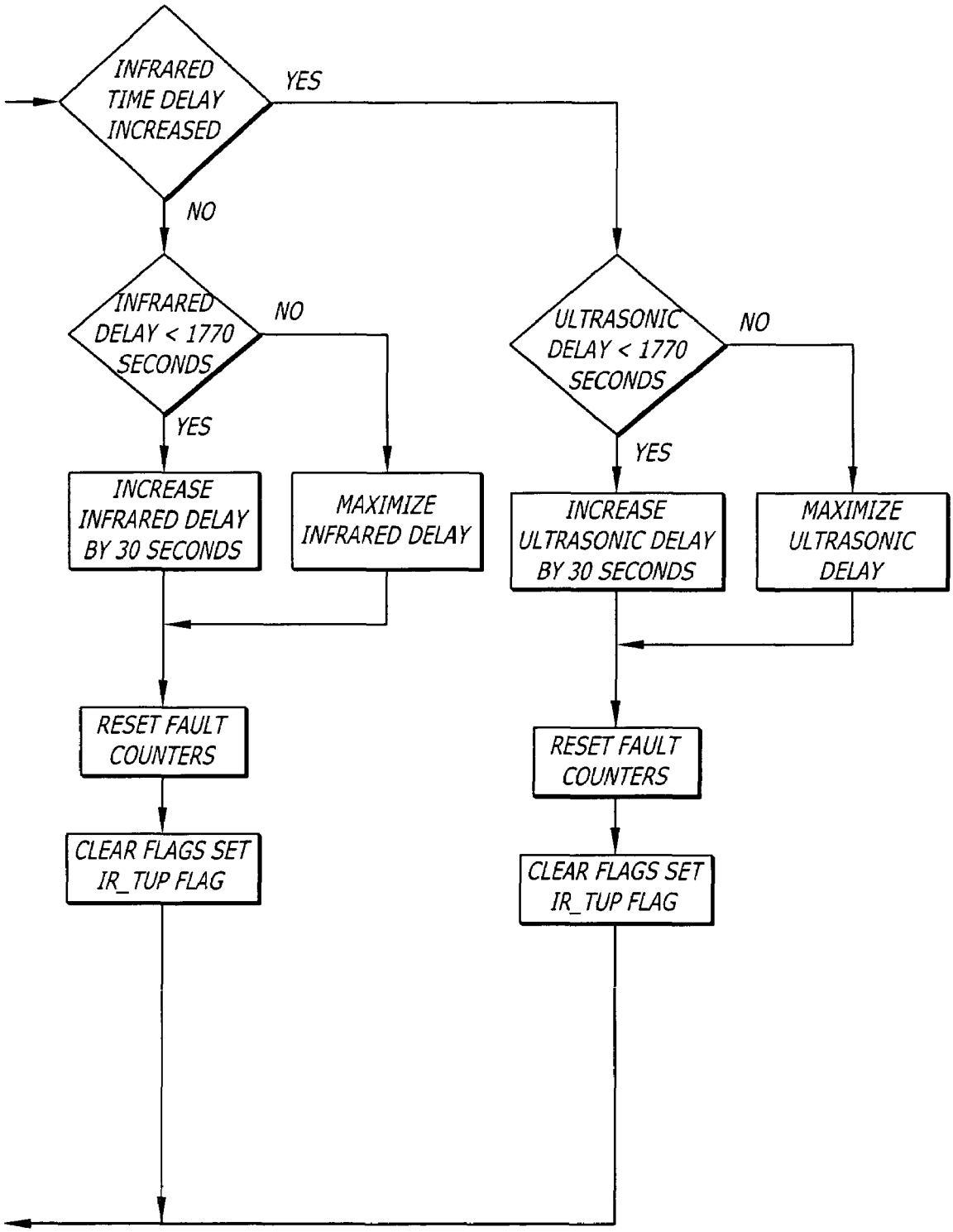

In FIG. 12, the adjustments are made once a fault is confirmed. Once the adjustment is made, the new parameters are stored into the non-volatile memory so that if/when the sensor is restarted it will begin using the parameters that have already been optimized. If a "Fault 1" is confirmed, the sensor first confirms that the threshold is not already greater than the detected peak motion, and that the threshold is not already maximized. The higher the threshold the less the sensitivity to motion. If these conditions allow, the threshold is incremented and the fault counters and flags are reset. If a "Fault 2" is confirmed, the sensor must attempt to decrease the infrared sensitivity which is logical since the sensor can only be activated by the infrared half, then a false on must be due to a false infrared detection. The sensor again confirms that the detected peak is not greater than the threshold and that the threshold is not already maximized. If these conditions allow, the threshold is incremented and the fault counters and flags are reset. For Fault 3 a false off can be caused by insufficient time delay of either half, or inadequate sensitivity of either half. If a "Fault 3" is confirmed, the sensor will sequence through a series of adjustments until the optimum settings are achieved. First adjustment will increase the ultrasonic sensitivity and if the ultrasonic delay for example is not less than 11 minutes, it will be decreased for example by 15 seconds. If the fault continues then the infrared sensitivity will be increased and the delay will be reduced for example by 15 seconds if greater for example than 16 minutes. If the fault still continues the infrared time delay will be increased for example by 30 seconds up to a maximum of for example 30 minutes. The 30-minute maximum is required by some state and local codes, and may soon be included in some national codes. If the fault still continues, the ultrasonic time delay will be increased for example by 30 seconds up to a maximum of for example 30 minutes. If the fault still continues then the sequence will begin again and continue until the optimum settings are achieved.

Figures 1, 13:
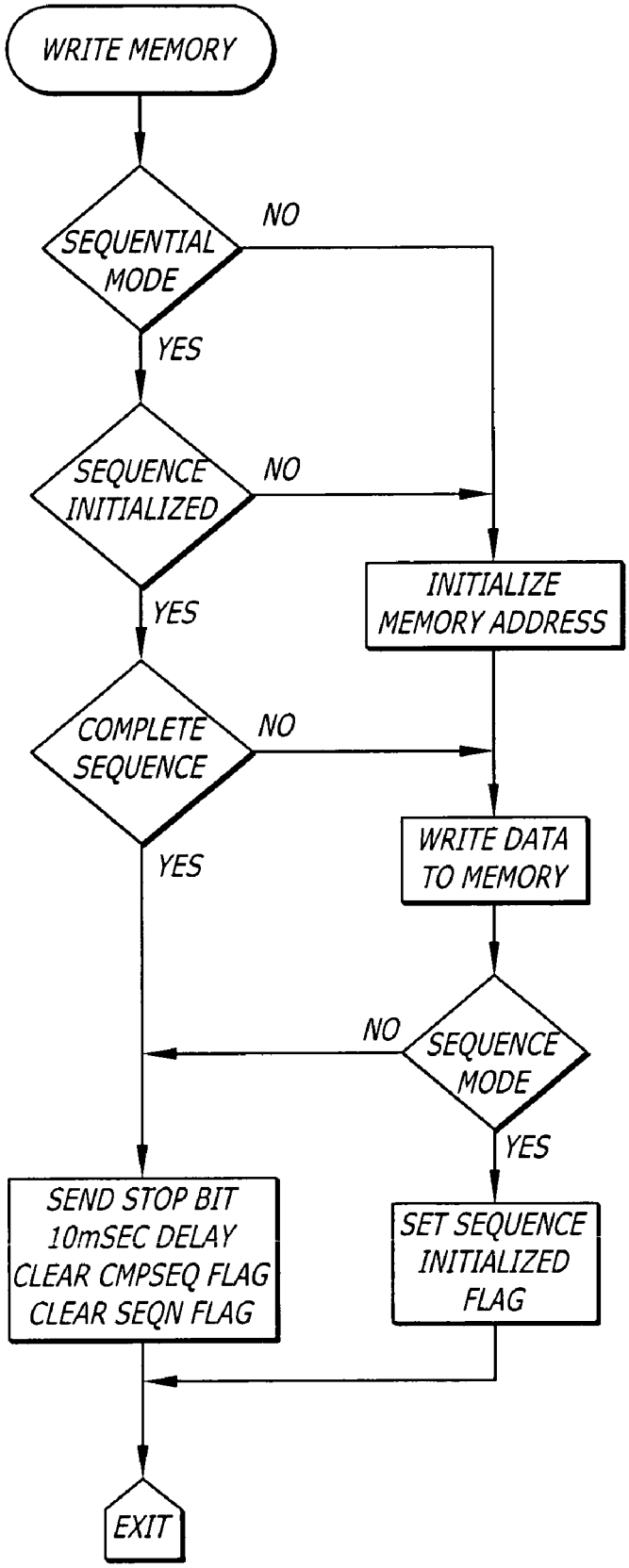
FIG. 13 is a flowchart showing the non-volatile memory routines.
Figures 2, 13:
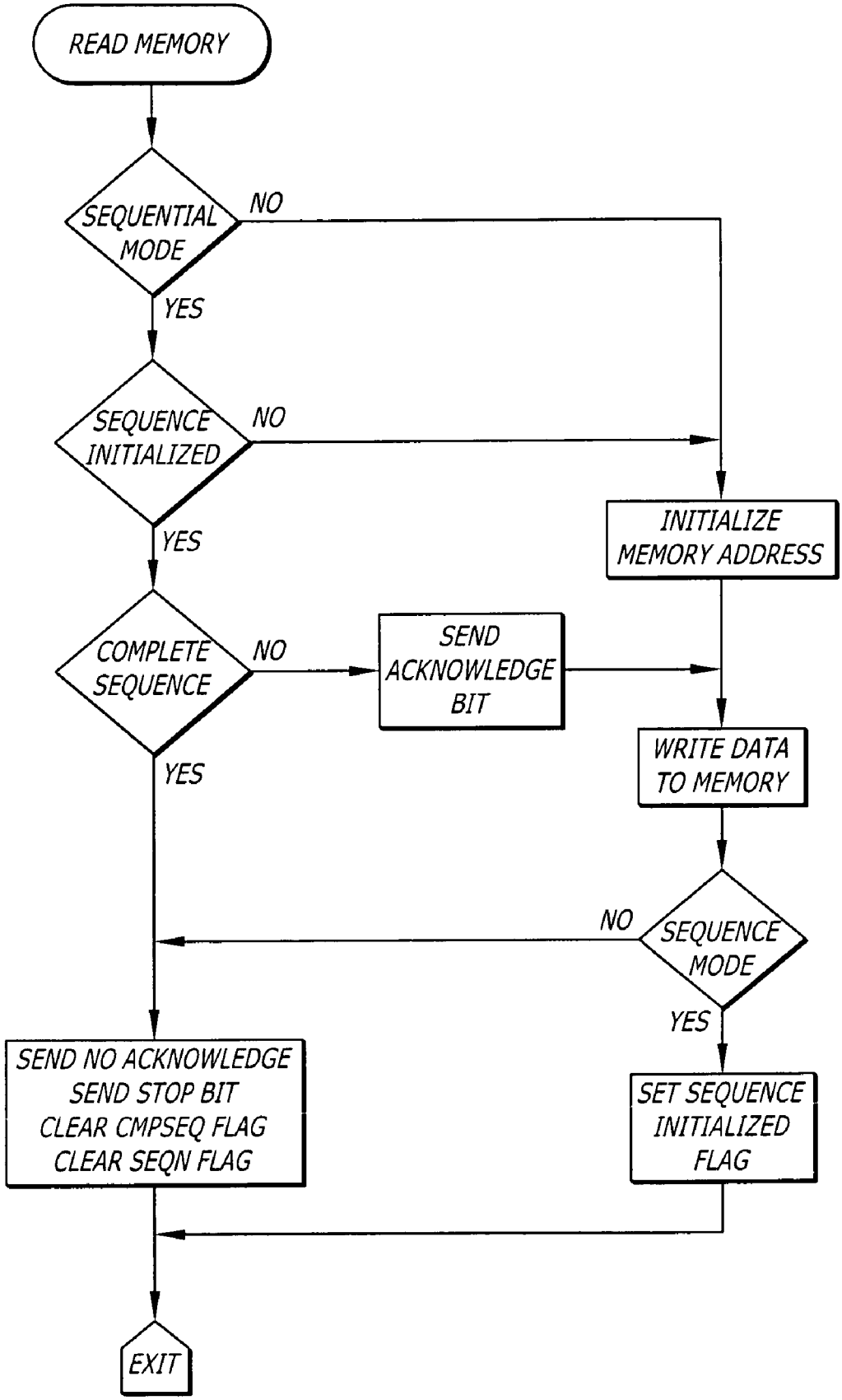

FIG. 13 shows the non-volatile memory routines. The IC may use the standard I2C protocol in sequential read and write modes. The stored variables are all eight-bit values which are added into a two byte checksum for verification upon startup. If the checksum is valid then the stored values will be used. If not, then either the memory has become corrupted, or possibly it is the first use of the sensor in which case the memory may never have been initialized.

Therefore, in accordance with the present invention, the occupancy sensor system includes dual technology sections which activate the controlled system when one particular technology section detects motion, and maintains activation of the controlled system when either of the dual technology sections detect occupancy, or optionally only when both detect occupancy. Occupants are assured that the controlled system will be activated and maintained reliably through the full no-gap coverage feature.

Self-adjusting sensitivity herein includes two aspects, base line and threshold. The baseline is constantly adjusting in real time such that a constant level of motion above the baseline is required to trigger the sensor. The threshold is adjusted both in real time and via fault detection. The baseline and threshold are tracked and adjusted separately for each sensing technology. At threshold, motion has to cross over a certain point. For rate of change, motion has to be over a certain time period and for a minimum duration. The system herein adjusts baseline in real time. Baseline movement may result for example from acoustic noise, air flow, or electrical noise. Previously, when a controlled system such as air conditioning came on, and the background environment moves up a small amount, if such motion gets close to the threshold, only a very small motion would exceed the threshold. The system herein moves so as to require a constant level of motion above or below the baseline for activation, which is more stable and less prone to false activation and more reliable for real motion detection. A rate of change comparator is adapted to prevent false activations in the infrared sensor section, by moving with the infrared signal, so that a slow motion, as from an air source, will not cause false activation regardless of the signal amplitude thereof. If the motion exceeds a programmed rate of change, looking more like human motion that air motion, the system activates.

The time delay herein is self-adjusted via the fault detection algorithm. Also, if the installer forgets to set the time delay, it will set itself for example to 10 minutes as a starting point from which the further adjustments will occur and it will not increase for example beyond 30 minutes.

Further, the occupancy sensor system herein may look two-ways into an area, for example with four transducers, two transmitters and two receivers, in the embodiment described above, or one-way into an area, for example with two transducers, one transmitter and one receiver. Self adjusting herein is provides so as to treat the infrared and the ultrasonic signals independently, and not by summing them together. The system functions in real time, rather then over extended periods of time.

Air flow rates are increasing, for example, in classrooms to prevent the sick room syndrome, and other items are moving as a result of increased air flow, such as flags, drawings, etc. which may otherwise cause false activations. Air flow tolerant technology determines the proper frequency spectrum and duration of the motion to confirm human motion rather than object motion. The occupancy sensor system herein distinguishes between human motion and air movement, to maximize energy savings in areas with high air flow, so as to overcome the problem of false activation in vacant areas. It also adapts to the occupant's behavior in real time. After an initial installation adjustment, it constantly self-adjusts the sensitivity and time delay to optimize performance parameters. System coverage remains constant regardless of environmental fluctuations. An automatic default is provided at minimum installation settings. Also, separate concurrent time delay settings for the dual technology sections avoid inadvertent deactivation in occupied areas. A manual-on option provides the flexibility to enable the controlled system to be activated manually, increasing savings in areas benefited thereby.

Multiple interface options herein enable connections and features for a variety of systems to be controlled thereby. A zero time delay feature provides a minimal closure for systems equipped with an internal timing function. An interface with an existing alarm system avoids false alarm activation through detection redundancy testing. The system includes redundancies, such as for example requiring three activations for each section of the sensor within a five minute period, for a controlled system such as lighting connected to an alarm system, to prompt a security guard seeing a light on and presuming a person is in the covered area when no one should be in the covered area, to prevent false activation as by people sitting at a computer and typing, while enabling activation as by a person stealing a computer. The system may include multiple frequencies from the ultrasonic sensor section, for example, to separate covered sub-areas within a covered area and prevent unintended activation of a remote sensor.

The system herein is operable in either automatic on or manual on. If an installer leaves the time delay at a minimum setting, the system may be configured to set itself up to a longer delay, for example one minute to five minutes. A selectable sweep function avoids unnecessary activation following power-up. In a sweep system, the controlled system may be routinely power-enabled through a series of areas at a certain time, such as enabling the power at 5:00 a.m. every morning, and if the sensor is unstable and powering up, the sweep looks like motion, which would generate false activation of the controlled system. The sweep system feature herein enables the user to enable or disable sweep activation of the infrared sensor section. The sample rate of the system is enhanced by alternate sampling of first one of the dual technologies, and, while it is being processed, sampling the other.

It is recommended that the sensor herein be installed with maximum connected systems operating such as air conditioning, to create maximum background motion so as to enable adjustment to prevent sensing thereof. However, sensors are frequently installed when the controlled system is shut down, preventing adjustment for conditions in the covered area. The system herein is adapted to self-adjust if the initial sensitivity is not accurate. Further, if the time delay is set at less than a setting for example of five minutes, the system will set itself up to an optimal initial setting of for example ten minutes and self-adjust from there. A minimum time delay for example of 15 seconds enables an installer to view system operations without waiting a long time to check the system, but if the minimum time delay setting is not changed the occupant would have to re-activate the system in the minimum time period. An installation timer assumes that an installer is finished if the controlled system is not activated for a period such as one hour, whereupon the system sets up the time delay for example at ten minutes and self adjusts for example between ten minutes and thirty minutes as required.

While the particular system as shown and disclosed in detail herein is fully capable of obtaining the objects and providing the advantages previously stated, it is to be understood that it is merely illustrative of the presently preferred embodiment of the invention, and that no limitations are intended to the details of construction or design shown herein other than as described in the appended claims.

We claim:

1. A system for sensing the occupancy of an area, able to activate upon sensing occupancy of the area, maintain activation when sensing continuing occupancy of the area, and enable self-adjusting of settings thereof, comprising:

an occupancy sensor, able to activate upon sensing the occupancy of the area, to maintain activation when sensing continuing occupancy of the area, to include settings therefor, and to enable self-adjusting of the settings, comprising an infrared sensor section, able to passively sense occupancy of the area, and to activate a signal thereupon, to continue to activate the signal upon sensing the continuing occupancy of the area, to include settings therefor, and to enable separate processing of the settings for only the infrared sensor section, and an ultrasonic sensor section, able to actively sense the occupancy of the area, to activate a signal upon sensing the continuing occupancy of the area, to include settings therefor, and to enable separate processing of the settings for only the ultrasonic sensor section, wherein the occupancy sensor is able to activate when the infrared sensor section senses occupancy of the area, and to maintain activation when either the infrared sensor section or the ultrasonic sensor section senses continuing occupancy of the area, and the signals in the infrared sensor section and the ultrasonic sensor section are each independently activated and form independent signals.

2. A system as in claim 1, wherein the independent infrared section signal and the independent ultrasonic sensor section signal are not combined to form a composite signal.

3. A system as in claim 1, wherein the separately-processed settings include time delay settings and sensitivity settings.

4. A system as in claim 1, wherein the occupancy sensor is able to activate upon sensing motion in the area.

5. A system as in claim 1, further comprising a motion-responding element for responding to motion varying from a baseline motion so as to require a constant level of such motion in order to activate the occupancy sensor.

6. A system as in claim 1, further comprising a building automation system relay, able to be connected to the occupancy sensor and a building automation system.

7. A system as in claim 1, further comprising an alarm relay, able to be connected to the occupancy sensor and to an alarm system, and a setting element which comprises a switch which is able to enable the selection of an alarm mode setting, and which is able to require multiple activations within a preset time period to activate the alarm relay.

8. A system as in claim 1, further comprising a switch for enabling the setting of a manual-on mode of the occupancy sensor.

9. A system as in claim 1, able to be connected to a system to be controlled thereby.

10. A system as in claim 1, further including a switch, wherein the switch is further able to enable selection of a lighting sweep setting, to prevent false activation in a power sweep facility.

11. A system as in claim 2, wherein the occupancy sensor is able to maintain activation when both the infrared sensor section and the ultrasonic sensor section are independently activated and form independent signals.

12. A system as in claim 3, wherein the separately-processed sensitivity settings include pre-programmed settings and self-adjusting settings.

13. A system as in claim 3, wherein the separately-processed time delay settings include pre-set settings and self-adjusting settings.

14. A system as in claim 3, wherein the separately-processed settings include self-adjusting time delay settings and self-adjusting sensitivity settings, and wherein the self-adjusting thereof comprise substantially moderate intermediate and incremental self-adjusting.

15. A system as in claim 3, wherein the separately-processed settings include self-adjusting time delay settings and self-adjusting sensitivity settings, and wherein the self-adjusting thereof is able to be responsive to real-time adjustment.

16. A system as in claim 3, wherein the occupancy sensor further includes an element for detecting a fault in the operation thereof, and the separately-processed settings include self-adjusting time delay settings and self-adjusting sensitivity settings, and wherein the self-adjusting thereof is able to be responsive to the fault detection.

17. A system as in claim 3, wherein the separately-processed settings include self-adjusting time delay settings and self-adjusting sensitivity settings, and wherein the self-adjusting thereof is further able to be self-resetting.

18. A system as in claim 3, wherein the time delay settings include a zero time delay setting for a system which is able to be connected to the occupancy sensor which includes an internal timing function.

19. A system as in claim 4, further comprising a filtering element for filtering out the portion of the frequency spectrum related to air movement, for preventing false activation of the occupancy sensor.

20. A system as in claim 6, further comprising a switch interface for enabling manual activation of the occupancy sensor such that the building automation system relay remains active during occupancy.

21. A system as in claim 7, able to provide redundant detection testing so as to avoid false alarms.

22. A system as in claim 8, further including a push button interface which includes a push button switch for enabling initial activation of the occupancy sensor after the setting of the manual-on mode.

23. A system as in claim 8, wherein the manual-on mode comprises a time delay setting for the occupancy sensor, and the occupancy sensor is able to automatically deactivate after manual activation following the time delay.

24. A system as in claim 9, wherein the controlled system comprises a lighting system.

25. A system as in claim 9, wherein the controlled system comprises a heating system.

26. A system as in claim 9, wherein the controlled system comprises an air conditioning system.

27. A system as in claim 10, further comprising a setting element, for enabling the input of a setting for the activating of the occupancy sensor, and a building automation system relay, able to be connected to the occupancy sensor and a building automation system, and wherein the setting element comprises a switch which is able to enable selection of the lighting sweep setting for the building automation system relay.

28. A system as in claim 10, further comprising a setting element, for enabling the input of a setting for the activating of the occupancy sensor, and an output control, able to be connected to the occupancy sensor and an output control system, and wherein the setting element comprises a switch which is able to enable selection of the lighting sweep setting for the output control system.

29. A system as in claim 12, wherein the separately-processed sensitivity settings of the ultrasonic sensor section further include an initial setting which is external to the pre-programmed settings.

30. A system as in claim 12, wherein the pre-programmed sensitivity settings include baseline settings, and threshold trigger-acquiring settings comprising the amount of motion above the baseline settings required to trigger occupancy detection.

31. A system as in claim 23, further including a grace timer, able to automatically activate the occupancy sensor within a grace period comprising a preset time after deactivation thereof.

32. A system as in claim 31, further including an automatic-on mode, and able to be self-resetting, and wherein the self-resetting is such that upon manual setting of a lights turned-off setting, in the system automatic-on mode, the lights stay off during occupancy, and upon vacating the area and elapse of the time delay and grace period, the lights turn on automatically the next time the area is entered.

33. A system for sensing the occupancy of an area, able to activate upon sensing occupancy of the area, maintain activation when sensing continuing occupancy of the area, and enable self-adjusting of settings thereof, comprising:

an occupancy sensor, able to activate upon sensing the occupancy of the area, to maintain activation when sensing continuing occupancy of the area, to include settings therefor, and to enable self-adjusting of the settings, including a motion-responding element for responding to motion varying from a baseline motion so as to require a constant level of such motion in order to activate the occupancy sensor.

34. A system for sensing the occupancy of an area, able to activate upon sensing occupancy of the area, maintain activation when sensing continuing occupancy of the area, and enable self-adjusting of settings thereof, comprising:

an occupancy sensor, able to activate upon sensing the occupancy of the area, to maintain activation when sensing continuing occupancy of the area, to include settings therefor, and to enable self-adjusting of the settings, including a building automation system relay, able to be connected to the occupancy sensor and a building automation system.

35. A system for sensing the occupancy of an area, able to activate upon sensing occupancy of the area, maintain activation when sensing continuing occupancy of the area, and enable self-adjusting of settings thereof, comprising:

an occupancy sensor, able to activate upon sensing the occupancy of the area, to maintain activation when sensing continuing occupancy of the area, to include settings therefor, and to enable self-adjusting of the settings, including an alarm relay, able to be connected to the occupancy sensor and to an alarm system, and a setting element which comprises a switch which is able to enable the selection of an alarm mode setting, and which is able to require multiple activations within a preset time period to activate the alarm relay.

36. A system for sensing the occupancy of an area, able to activate upon sensing occupancy of the area, maintain activation when sensing continuing occupancy of the area, and enable self-adjusting of settings thereof, comprising:

an occupancy sensor, able to activate upon sensing the occupancy of the area, to maintain activation when sensing continuing occupancy of the area, to include settings therefor, and to enable self-adjusting of the settings, including a switch for enabling the setting of a manual-on mode of the occupancy sensor.

37. A system for sensing the occupancy of an area, able to activate upon sensing occupancy of the area, maintain activation when sensing continuing occupancy of the area, and enable self-adjusting of settings thereof, comprising:

an occupancy sensor, able to activate upon sensing the occupancy of the area, to maintain activation when sensing continuing occupancy of the area, to include settings therefor, and to enable self-adjusting of the settings, including a switch, wherein the switch is further able to enable selection of a lighting sweep setting, to prevent false activation in a power sweep facility.

38. A system for sensing the occupancy of an area, able to activate upon sensing occupancy of the area, and maintain activation when sensing continuing occupancy of the area, comprising:

an occupancy sensor, able to activate upon sensing the occupancy of the area, to maintain activation when sensing continuing occupancy of the area, to include settings therefor, and to be connected to a system to be controlled thereby, wherein the occupancy sensor includes a building automation system relay, able to be connected to the occupancy sensor and a building automation system, and an interface which includes a switch which is able to toggle the state of the controlled system between on and off, wherein the switch is able to toggle the controlled system off while the building automation system relay remains active.

39. A system for sensing the occupancy of an area, able to activate upon sensing occupancy of the area, and maintain activation when sensing continuing occupancy of the area, comprising:

an occupancy sensor, able to activate upon sensing the occupancy of the area, to maintain activation when sensing continuing occupancy of the area, and to include settings therefor, wherein the occupancy sensor includes a switch for enabling the setting of a manual-on mode, which comprises a time delay setting, and further includes an indicator which emits a visible indication of occupancy detection, and wherein switching to set the manual-on mode inhibits activation of the indicator in response to continued occupancy detection.

* * * * *